US005697881A

United States Patent [19]

Nishihara

[11] Patent Number: 5,697,881

[45] Date of Patent: Dec. 16, 1997

[54] FOLDING MACHINE WITH COLLECTION MECHANISM

[75] Inventor: Kunisuke Nishihara, Yokohama, Japan

[73] Assignee: Toshiba Kikai Kabushiki Kaisha, Japan

[21] Appl. No.: 352,791

[22] Filed: Dec. 1, 1994

[30] Foreign Application Priority Data

Dec. 1, 1993 [JP] Japan ..... 5-301613

[51] Int. Cl.[6] ..... B31F 1/10

[52] U.S. Cl. ..... 493/429; 270/45

[58] Field of Search ..... 493/425, 426, 493/427, 428, 429, 432, 471, 476; 270/45, 8

[56] References Cited

U.S. PATENT DOCUMENTS

| | | | |
|---|---|---|---|
| 4,159,823 | 7/1979 | Bryer et al. | 493/425 |
| 4,345,906 | 8/1982 | Gregoire | 493/432 |
| 4,352,671 | 10/1982 | Petersen | 493/432 |
| 5,088,708 | 2/1992 | Nowak | 493/427 |
| 5,242,823 | 9/1993 | Marmin | 493/429 |

*Primary Examiner*—Scott A. Smith
*Assistant Examiner*—Darren Ark
*Attorney, Agent, or Firm*—Cushman Darby & Cushman Intellectual Property Group of Pillsbury Madison & Sutro, LLP

[57] ABSTRACT

A folding machine is provided with a collection mechanism to permit abatement of load deviation and also the amount of time required for changeover from the collection mode to the non-collection mode in shortened. The folding machine with collection mechanism includes a fixed cam 31 forming a cam profile 31A for a predetermined delivering action of a pin 15B in a collection cylinder 15 and a rotating cam 30 having a screening portion 30A to screen the cam profile 31A every other time the pin 15B reaches the delivering operation position KK using the screening portion 30A in a collection mode so as to deliver a piled, layered fold section and to not screen the cam 31A every time the pin 15B reaches the delivering operation position KK in a non-collection mode so as to delivery a non-piled, non-layered fold section.

8 Claims, 15 Drawing Sheets

FOLDING MACHINE WITH COLLECTION MECHANISM

BACKGROUND OF THE INVENTION

1. Field of the Invention

This invention relates to a method of assembling a folding machine with collection mechanism provided for a printing press, such as a web offset printing press. More particularly, the folding machine with collection mechanism provides a non-collection mode delivering one by one as a non-piled, non-layered fold section, folded up at every predetermined pattern without piling; a collection mode delivering as a pile layered fold section, folded up 2-pile about two sorts of fold sections cut from printing paper printed continuously with two alternating patterns.

2. Description of the Related Art

FIG. 13 to FIG. 17 depict a conventional folding machine with collection mechanism 900 (the first conventional example).

The folding machine with collection mechanism 900 in FIG. 13 is broadly concerned with a folding machine for a web offset printing press including a plate cylinder (double-size cylinder) with twice the circumference of the usual plate cylinder (for example, in the case of B-size printing paper, 1092 mm rather than the usual 546 mm), and more particularly for including a former 901, a cutting cylinder 903, a paper pin cylinder 904, a collection cylinder (or a tucker cylinder, a folding cylinder) 905, a gripper cylinder 906, and up and down slowdown cylinder 907, 908 from the upstream (the right of the drawing) to the downstream (the left of the drawing) in a course of the printed paper.

The process of disposal of the printing paper and motions of respective parts in the folding machine with collection mechanism 900 are described as a printed paper 902 which is continuously printed alternative two sorts of the pattern A and the pattern B is folded along a machine direction or a longitudinal direction by the former 901. The printed paper 902 folded along a machine direction is inserted through between the cutting cylinder 903 and the paper pin cylinder 904 and then is cut at a length of the pattern A or the pattern B by two cutting blades 903A located in the cutting cylinder 903. Because of the cutting action, the printed paper 902 becomes separated to a fold section 902A and a fold section 902B, having the pattern A and the pattern B. Respective fold sections 902A, 902B are hung one by one in sequence by a 2-line pin 904A arranged in the paper pin cylinder 904 and then delivered in sequence to a 3-line pin 905B (a located 120 degree angle) arranged in the collection cylinder 905.

The collection cylinder 905 includes tucker blades (or folding blades) 905A among respective 3-line pins 905B (a located 120 degree angle) and the gripper cylinder 906 provided adjacent the collection cylinder 905 includes a 6-line gripper 906A (a located 60 degree angle). Respective fold sections 902A, 902B hung by the pins 905B in the collection cylinder 905 are delivered to the gripper cylinder 906 with gripping and folding (folding in a cross direction) in a state of one by one (in a non-collection mode) or in a state of 2-pile (in a collection mode) when the tucker blade 905A in the collection cylinder 905 and the gripper 906A in the gripper cylinder 906 align.

Non-collection mode

In the non-collection mode, delivering motion by gripping and folding from the collection cylinder 905 to the gripper cylinder 906 is executed whenever there is alignment of the tucker blade 905A in the collection cylinder 905 and the gripper 906A in the gripper cylinder 906; every two time the plate cylinder (not shown) makes a full circle. Respective fold sections 902A, 902B hung one by one by the grippers 906A in the gripper cylinder 906 are delivered alternately from the gripper 906 to up and down slowdown cylinders 907, 908 and also exhausted to up and down taking-off tables via (not shown) conveyer belt, impeller.

Collection mode

On the other hand, in the collection mode, delivering motion by gripping and folding from the collection cylinder 905 to gripper cylinder 906 is not executed at every agreement of the tucker blade 905A in the collection cylinder 905 and the gripper 906A in the gripper cylinder 906 but in a timing of every other time; one in every full circle of the plate cylinder (not shown). The pile layered fold sections (a 2-pile state of the fold section 902A and the fold section 902B) hung on the gripper 906A in the gripper cylinder 906 are delivered to whichever one the up or down slowdown cylinder 907, 908 from the gripper 906A and then exhausted to whichever one the up or down taking-off table via the (not shown) conveyer belt, impeller.

FIG. 14 is an explanatory drawing of how the respective fold sections 902A, 902B in the collection cylinder 905 come to the 2-pile state and FIG. 14(A) to FIG. 14(F) respectively depict the state of every ⅓ turn (a 120 degree turn) of the collection cylinder 905. Respective symbols A1, B1, A2, B2, A3, and B3 represent respective fold section 902A, 902B sent alternately in sequence from the paper pin cylinder 904 at the symbol IN position and the symbol OUT represents a position of delivering to the gripper cylinder 906.

In FIG. 14(A), the fold section A1 is delivered to the gripper cylinder 906 at the point of symbol OUT. Then the fold section A1 becomes waste because of an unpiled state.

In FIG. 14(B), the fold section B1 is not delivered to the gripper cylinder 906 and is left for passing through the symbol OUT.

In FIG. 14(C), the fold section A2 is delivered to the gripper cylinder 906 at the point of the symbol OUT. Then the fold section A2 becomes spoilage because of the unpile state like the fold section A1.

In FIG. 14(D), the fold section B2 is not delivered to the gripper cylinder 906 and is left for passing through the symbol OUT. The fold section A3 delivered in is piled on the fold section B1, so that the pile layered fold section is formed by placing inside the pattern B and outside the pattern A.

In FIG. 14(E), the pile layered fold section formed with the fold section A3 and the fold section B1 is delivered to the gripper cylinder 906. Thereat first, the pile layered fold section folded in a cross direction is formed in the 2-pile state.

In FIG.(F), the fold section B3 is not delivered to the gripper cylinder 906 and is left for passing through the symbol OUT. The fold section A4 delivered in is piled on the fold section B2, so that the pile layered fold section is formed by placing inside the pattern B and outside the pattern A.

As FIG. 14(F) is the same state as FIG. 14(D), thereafter the state of FIG. 14(E) and FIG. 14(F) repeat alternately and every other one the pile layered fold section is delivered to the gripper cylinder 906. The pile layered fold section is always formed by placing inside the pattern B and outside the pattern A.

The state of FIG. 14(E) and FIG. 14(F) repeats alternately, so that spoilage is originated only in the state of FIG. 14(A) and FIG. 14(C), only the first turn of the collection cylinder 905.

In the folding machine with collection mechanism 900, the tucker blade 905A and the pin 905B in the collection cylinder 905 includes respective three lines and the pile layered fold section might be formed with an odd number line such as five lines and seven lines.

FIG. 15 depicts a collection mechanism 920 and the collection cylinder 905 which are capable of changing over from the motion of pin 905B in response to the non-collection mode to the motion of pin 905B in response to the collection mode.

FIG. 13 to FIG. 15, the pin 905B in the collection cylinder 905 is structured to necessarily move in and out per arrow C in FIG.13 with a turn of the pin drive shaft 921. When the pin projects out, respective fold sections 902A, 902B are held to be hung and when the pin disappears inside, respective fold sections 902A, 902B are delivered to the gripper cylinder 906. Respective fold sections 902A, 902B are delivered to the gripper cylinder 906 at the position of agreement or alignment of the tucker blade 905A in the collection cylinder 905 and the gripper 906A in the gripper cylinder 906, and the position of the pin 905B responding thereat (thereinafter a delivering operation position) is identical with a point K in FIG. 13 whereat toward the half length of turning respective to fold section 902A, 902B.

Therefore in the non-collection mode, the pin 905B carries out the disappearing motion every passing through the position K in FIG. 13 (every ⅓ turn of the collection cylinder 905), and in the collection mode, the pin 905B carries out the disappearing motion every other one of passing through the position K in FIG. 13 (every ⅔ turn of the collection cylinder 905).

In FIG. 13, the gripper 906A in the gripper cylinder 906 in response to fixed tucker blade 905A in the collection cylinder 905 is structured to be operated every delivery of respective fold sections 902A, 902B to the gripper cylinder 906, every disappearing motion of the pin 905B in the collection cylinder 905.

The six line gripper 906A in the gripper cylinder 906 is operated all in the non-collection mode and the six lines of the gripper 906A are operated every other one line in the collection mode.

In FIG. 15, the collection mechanism 920 includes a cam roller lever 922 revolving around a pin drive shaft 921, a cam follower 924 coupled to the cam roller lever 922 through a cam follower shaft 923, and a rotating cam 930 guiding the cam follower 924.

The rotating cam is applied in the collection cylinder 905 and on the axis and is structured to be driven in gear with rotation of the collection cylinder 905. The rotating rate of the rotating cam 930 to the collection cylinder 905 is 3/2, that is as the collection cylinder 905 makes a ⅓ turn (a 120 degree turn), the rotating cam 930 makes a ½ turn (a 180 degree turn).

FIG. 16(A) depicts a front view of the rotating cam 930 and FIG. 16(B) depicts a side elevation view of the rotating cam 930.

The rotating cam 930 includes a guide groove 931 guiding the cam follower 924 and predetermined cam curve is formed by the guide groove 931. The cam follower 924 enclosed into the guide groove draws predetermined locus base on the cam curve with turning along the guide groove 931 and controls the action of pin 905B in the collection cylinder 905.

A part of the rotating cam 930 is formed from a segment cam 932. Segment cams 932 are located at two symmetric positions on the circumference of the rotating cam 930 and a front surface 932A and a rear surface 932B thereon have each different configuration of the guide groove 931. The segment cam 932 is structured to permit detaching from the body of rotating cam 930 (other parts of the segment cam 932) and attaching inside out. FIG. 17 depicts the rotating cam 930 with the other segment cam 932 attached inside out.

As FIG. 16(A) depicts, the front surface 932A side of the segment cam 932 includes the guide groove 931 which is a different configuration from the body of rotating cam 930 and a cam protuberance 933 is formed on the cam curve.

On the other hand as FIG. 17 depicts, the rear surface 932B side of the segment cam 932 includes the guide groove 931 which is the same curvature radius as the body of rotating cam 930.

Mode change by the rotating cam

The pin 905B in the collection cylinder 905 carries out the disappearing motion when the cam follower 924 climbs up the cam protuberance 933 and carries out the re-projecting motion when the cam follower 924 descends down the cam protuberance 933.

In the non-collection mode, the rotating cam 930 configured as shown in FIG. 16(A) wherein the two cam protuberances 933 (located 180 degrees apart) are formed on the cam curve. The phase of the rotating cam 930 is planned such that the other cam protuberance 933 reaches the delivering operation position (the position K in FIG. 13) as the pin 905B reaches thereto (no consideration of dislocation between the pin 905B and the cam follower 924 for the pin 905B). The next cam protuberance 933 reaches the position K by the time the rotating cam 930 makes a 180 degree turn as the next pin 905B reaches the position K, while the collection cylinder 905 makes a 120 degree turn because the rotation rate of the rotating cam 930 to the collection cylinder 905 is 3/2. The pin 905B carries out the disappearing motion and respective fold sections 902A, 902B in the state of non-pile are delivered to the gripper cylinder 906 the respective pins 905B pass through the position K.

The rotating cam 930 having one cam protuberance 933 formed on the cam curve as shown in FIG. 17 is applied in the collection mode. The phase of the rotating cam 930 is planned such that the cam protuberance 933 reaches the delivering operation position (the position K in FIG.13) as the pin 905B reaches thereto, thereupon, the position K moves to the opposite side of the cam protuberance 933 because the rotating cam 930 made a 180 degree turn as next pin 905B reaches the position K because the collection cylinder 905 made a 120 degree turn. Then as the collection cylinder 905 makes a 120 degree turn again and next pin 905B reaches the position K, the rotating cam 930 makes a 180 degree turn again and the cam protuberance 933 reaches the position K again. When respective pins 905B pass through the position K, every other time, the pin 905B carries out the disappearing motion, and the pile layered fold section of the fold section 902A and the fold section 902B is delivered to the gripper cylinder 906.

Mode change by plural cams

A folding machine with collection mechanism illustrated in Japanese Patent Application Laid-open No.H 5-154985 and Japanese Patent Application Laid-open No.H 5-178533 is assigned as a folding machine to change a pile (equivalent the collection mode) and a non-pile (equivalent the non-collection mode) with plural cams (The second conventional example).

The folding machine with collection mechanism in the second conventional example includes a pin apparatus (equivalent the pin 905B in the first conventional example) and a folding blade apparatus (equivalent the tucker blade 905A in the first conventional example) and the pin apparatus and the folding blade apparatus include respective two cams to change the pile and the non-pile. Four cams in total are attached.

Respective two cams in the apparatuses are assorted with a non-pile cam having the two cam profiles (the recessed portion) arranged a 180 degree angle and a dummy cam to cause one cam profile of the two cam profiles for the non-pile cam to operate or not operate.

In the second conventional example the state of pile (equivalent the collection mode) means the state of non-operation (the state of screening the recessed portion, turning along the peripheral portion of the dummy cam because the cam follower can not fall into the recessed portion) for the dummy cam as one cam profile of the two cam profile for the non-pile and in the state of non-pile (equivalent the non-collection mode), the dummy cam is located according to the state of operation (the state of non-screening the recessed portion, turning along the cam profile as the cam follower falls into the recessed portion) of both cam profiles for the non-pile cam.

The cam profile having the non-pile cam always turns with turning of the collection cylinder (folding cylinder) in driving whichever, the pile or the non-pile. As the collection cylinder makes a 120 degree turn (one of the locating intervals of pin or folding blade), the non-pile cam makes a 180 degree turn (one of the locating intervals of cam profile). The dummy cam is in state of turning at the same speed as the non-pile cam and in state of fixing on the frame.

When changing from the non-pile to the pile or when changing from the pile to the non-pile, the relative phasing between the dummy cam and the non-pile cam using a 2-point clutch is alternated because the change-over operation is made easier and the time required for changing is shortened.

The folding machine with collection mechanism 900 in the first conventional example, however, has an occasion that load deviation is yielded in the drive system in the rotating cam 930 due to the rotating cam 930 receiving counterforce from the cam follower 924 which passes through the cam protuberance on the cam curve in the rotating cam 930.

Rotation angular acceleration $d^2\phi/dt^2$ (rad/s$^2$) is produced in the cam roller lever 922 turning (fluctuation) around the pin drive shaft 921 as the cam follower 924 passes through the cam protuberance 933 in FIG. 18. $\phi$ means a rotation angle (rad) of the cam roller lever 922.

In FIG. 18, the pin drive shaft 921 is screwed in state of feasible turn (rotation) in an adjacent surface of the collection cylinder 905 to turn (revolve) with turning of the collection cylinder 905. Both the collection cylinder 905 and the rotating cam 930 turn toward the same direction (counter-clockwise in the drawing), while the collection cylinder 905 and the pin drive shaft 921 turns clockwise provided that the rotating cam 930 is stationary since the rotation rate of the rotating cam 930 is 3/2.

When the rotation angular acceleration $d^2\phi/dt^2$ is produced in the cam follower 924, force related to the product $I \times d^2\phi/dt^2$ of the rotation angular acceleration $d^2\phi/dt^2$ and the moment of inertial I around the pin drive shaft 921 of the whole (the cam follower 924, the cam roller lever 922 and others) operated by the rotating cam 930 makes the action to the rotating cam 930 as counterforce F.

The counterforce F working against the rotating cam 930 works in a normal direction at the contacting point of the rotating cam 930 and the cam follower 924 and provided that rotational direction constituent FX and radial direction constituent FY are classified, the counterforce F works to the radial direction constituent FY as the cam follower 924 passes through parts except the cam protuberance 933 and the rotational direction constituent FX is occurred as the cam follower 924 passes through the cam protuberance 933. The rotational direction constituent FX is equal to force working in the direction of rotation to the rotating cam 930, so that load deviation is produced in the drive system in the rotating cam 930 when the rotational direction constituent FX is fluctuated by changing the rotation angular acceleration $d^2u/dt^2$ of the cam roller lever 922.

Thereat, FIG. 19 depicts changing form (relation between lift degree Y(mm) and change angle X(rad)) of the cam curve in part of the cam protuberance 933 and FIG. 20 depicts curve $d^2Y/dX^2$ for differentiating twice the cam curve in FIG. 19. The form of curve $d^2Y/dX^2$ is charted as form changing positive, negative, negative, positive as the drawing shows.

When the length of the cam roller lever 922 between the cam follower 924 and the pin drive shaft 921 is R(mm) and the relative rotation angular speed of the collection cylinder 905 to the rotating cam 930 is $\omega$ (rad/s; =dX/dt=constant), the following formula (number 1) is effected, consequently the rotation angular acceleration $d^2\phi/d$ alternates positive, negative, negative, positive in response to the changing form of the curve $d^2Y/dX^2$ in FIG. 20:

$$d^2\phi/dt^2=(1/R)\times d^2Y/dt^2=(1/R)\times\omega^2\times d^2Y/dX^2 \qquad \text{Number 1}$$

As the cam follower 924 passes over the cam protuberance 933, the load deviation is produced in the drive system in the rotating cam 930 toward the direction of positive, negative, negative, positive (the relative turning direction of the collection cylinder 905 to the rotating cam 930, the direction of positive is equivalent to the sliding direction of the cam follower 924 to the cam protuberance 933).

The above described load deviation produced in the rotating cam 930 affects drive of the collection cylinder 905 interlocking therewith and non-uniformity of turn is produced in respective cylinders in the folding machine with collection mechanism 900 including the collection cylinder 905, the gripper cylinder 906 and others. The non-uniformity of turn affects cutting accuracy and folding accuracy and the folding sections 902A, 902B become inferior.

As the foregoing description the formula (number 1), the rotation angular acceleration $d^2\phi/dt^2$ of the cam roller lever 922 is proportionate to a square of the relative rotation angular speed $\omega$ of the collection cylinder 905 to the rotating cam 930. The relative rotation angular speed $\omega$ is increased in proportion to the square at high machine speed (the rotation angular speed of collection cylinder 905), so that the rotation angular acceleration $d^2\omega/dt^2$ of cam roller lever 922 is increased in proportion to the square and then the volume of load deviation produced in the drive system of rotating cam 930 is increased by reason of high machine speed. Therefore a problem was that cutting accuracy and folding accuracy in the folding section 902A, 902B become more inferior.

A problem was that machine life fell because the rotation angular acceleration $d^2\phi/dt^2$ of cam roller lever 922 was changed to positive, negative, negative, positive with the changing form of curve $d^2y/dx^2$ in FIG. 20 and alternate load deviation was produced toward positive, negative, negative, positive in the drive system of rotating cam 930 therewith, so that fatigue was produced in teeth of respective gears in the drive system of rotating cam 930 by repeating alternate load.

A problem was that much time was required to change because changeover between the collection mode and the non-collection mode was performed by replacing the inside and outside for one segment cam 932 attached reversibly was restricted to be performed with the cam follower 924 outside of the guide groove 931 in segment cam 932 and the setting was delayed.

The folding machine with collection mechanism in the second conventional example serves shortening of required time for changeover and ease of change-over operation by using the 2-point clutch to change the pile and the non-pile and the second conventional example has some of the same problems as the first conventional example because the cam for non-pile having the cam profile is structured to always turn in operating pile or non-pile, so that load deviation is produced in the drive system of the cam or non-pile as the cam follower passes through the cam profile.

It is an object of this present invention to offer a folding machine with collection mechanism which permits the change-over operation of pile and non-pile in a short time and easily, and reduces the load deviation produced in the rotating cam drive system.

SUMMARY OF THE INVENTION

To attain the above object, the present invention provides a cam profile in a rotating cam, not in a fixed cam.

Accordingly, the present invention is to provide a folding machine with collection mechanism to operate in change a non-collection mode delivering two sorts of fold section, which are sent alternately, one by one as a non-piled, non-layered fold section from a collection cylinder to a gripper cylinder located thereby and a collection mode delivering as a piled layered fold section having; a fixed cam which forms a cam profile to carry out predetermined delivering action for pins in the collection cylinder and which is secured opposite a frame side and a rotating cam having a screening portion to screen or mask the cam profile; and a rotating cam drive means with which the screen portion of the rotating cam is located to non-screen the cam profile at the moment of the pins reach predetermined delivering action position in the non-collection mode and to screen the cam profile every other time the pins reaches predetermined delivering action position in the collection mode.

In the present invention, the folding machine with collection mechanism is operated to change the non-collection mode and the collection mode by virtue of using two cams in the fixed cam and the rotating cam.

A driving control is conducted under state that the fixed cam having the cam profile is always secured opposite the frame side and the rotating cam is located in response to respective modes by the rotating cam drive means.

Thereat, the cam profile is not fitted in the rotating cam but the fixed cam, so that in regard to the rotating cam the cam follower passes only through a peripheral portion of the rotating cam (a part of having defined curvature unformed the cam profile). Counterforce that the rotating cam receives from the cam follower works only radially of the rotating cam (direction toward the rotational axis of the rotating cam), so that load deviation as was described in the first and second conventional examples is not produced in the drive system of the rotating cam and the problems with load deviation are eliminated. Therefore, the cutting accuracy and folding accuracy of fold section will be improved because rotation of the rotating cam becomes stable and non-uniformity of turn of respective cylinders such as the collection cylinder interlocking the rotating cam, the gripper cylinder and others are controlled.

The higher the machine speed, a difference of the cutting accuracy and folding accuracy of the fold section with the foregoing first and second convention examples will be conspicuous.

Machine life will be extended because fatigue produced by alternate repeating load in teeth of respective gears structuring the drive system of rotating cam can be prevented.

Changeover between the collection mode and the non-collection mode will be possible to be performed easily and in a shorter time because of only changing the state of the rotating cam in respective modes.

The collection mode and the non-collection mode of simple structure for the rotating cam and the fixed cam are realized and then for the reasons noted the objects of the invention are achieved.

In the folding machine with collection mechanism of the present invention, the rotating cam drive means includes a drive transmission system provided between the collection cylinder and the rotating cam and a clutch to be provided as part of the drive transmission system and to be in intermittent interlock with the collection cylinder and the rotating cam.

By providing the clutch as part of the drive transmission system, ON-OFF of the clutch allows for the easy changeover foregoing operation rotating cam in collection mode and foregoing interrupting rotating cam in non-collection mode. The ON-state of clutch permits the collection mode and the OFF-state of clutch permits the non-collection mode.

The folding machine with collection mechanism in the present invention is structured such that the rotating cam has the rotation rate of 3/2 to the collection cylinder in the collection mode and has the screening portion at one position on the peripheral portion and it is further constructed such that the clutch causes the rotating cam to connect at predetermined one phase for an optional state of the collection cylinder.

The folding machine with collection mechanism in the present invention is structured such that the rotating cam has the rotation rate of 3/4 or 5/4 to the collection cylinder in the collection mode and has the screening portion at two almost symmetrical positions with respect to the rotating axis and the clutch causes the rotating cam to connect at predetermined one phase or predetermined two phase in 180 degree phase respectively for an optional state of the collection cylinder.

Where the rotation rate of the rotating cam to the collection cylinder is 3/4 or 5/4, the folding machine with collection mechanism could be structured such that the clutch is assigned as a one-point clutch to connect part of the collection cylinder side containing the clutch and part of the rotating cam side only at predetermined one phase and it is further constructing the clutch of part of the rotating cam has 1 or 2 times the rotating rate to the rotating cam.

The changeover of the rotating cam in the foregoing respective modes is certainly realized for the form of rotating cam and the structure of clutch are assigned as foregoing form and structure whichever in case of 2/3 or case of 4/3 or 4/5 of the rotation rate of the rotating cam to the collection cylinder.

The folding machine with collection mechanism in the present invention includes the rotating cam drive means having an air cylinder to be operated from away for ON-OFF of the clutch, having a phase sensing means to detect the phase of rotating cam and having a stationary means to hold fast in the state of interrupting the rotating cam in the non-collection mode.

An operator's burden can be lightened because the air cylinder operates the ON-OFF of the clutch from away and the rotating cam can be stopped at a predetermined stop position based on an output signal from phase sensing means in the non-collection mode when the air cylinder, the phase sensing means and the stationary means are provided as described above.

The folding machine with collection mechanism of the present invention has the rotating cam drive means including a control device to changeover automatically the collection mode and the non-collection mode by controlling the air cylinder.

The operator's burden is less and the time for changing is shortened greatly when the foregoing control device is provided.

DETAILED DESCRIPTION OF THE PREFERRED EMBODIMENTS

Hereinafter embodiments of the present invention will now be described with reference to the drawings.

FIG. 1 to FIG. 8 depict a folding machine with collection mechanism 10 related to the first embodiment of the present invention.

Figure 1:
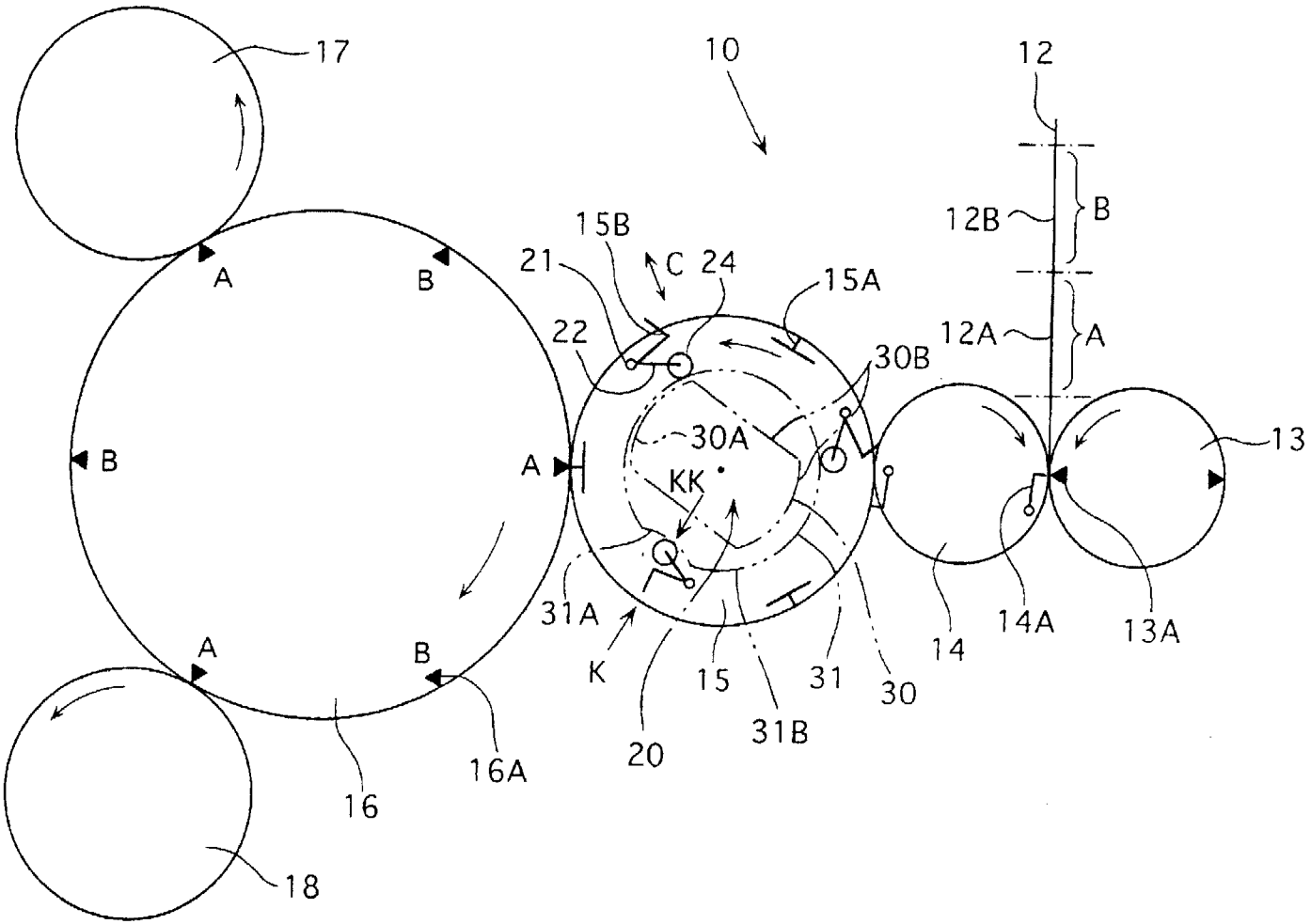
FIG. 1 is an appearance of the overall composition view of the first embodiment of the present invention.
Figure 13:
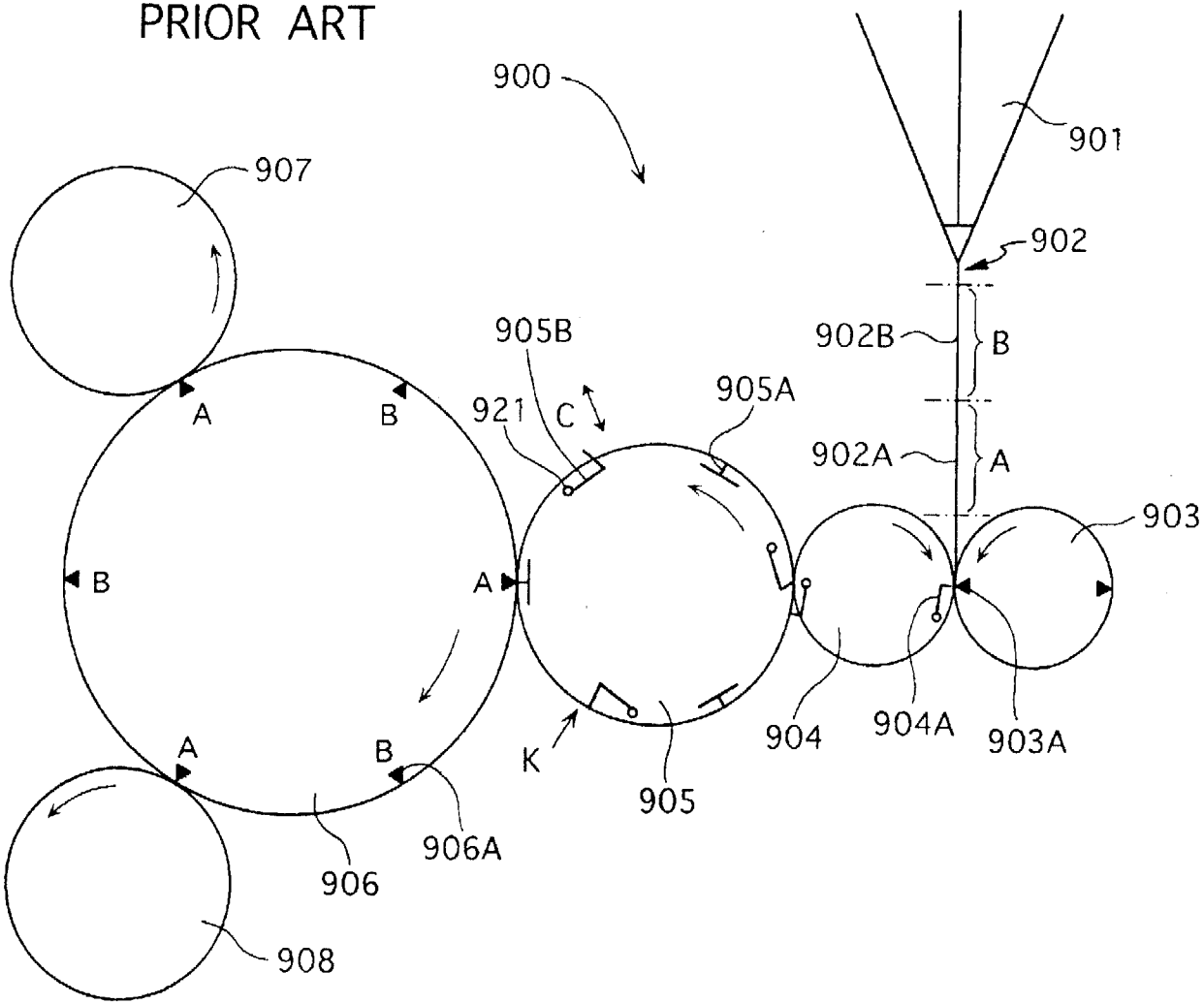
FIG. 13 PRIOR ART
FIG. 13 is an appearance of the overall composition view of the first conventional example.
Figure 14A:
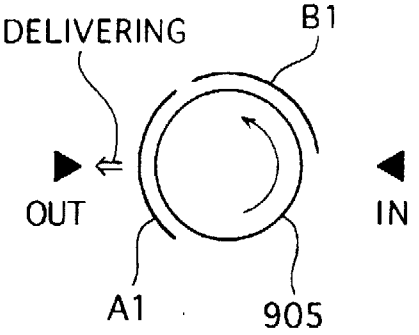
FIG.14(A) PRIOR ART
FIG. 14 is an explanatory diagram of method of forming the piled layered fold section in the first conventional example.
Figure 14B:
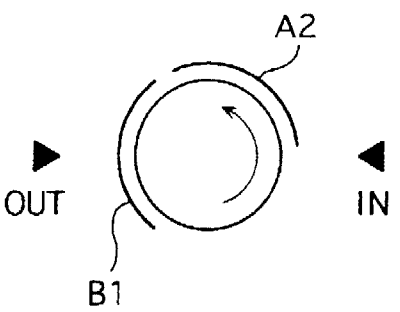
FIG.14(B) PRIOR ART
Figure 14C:
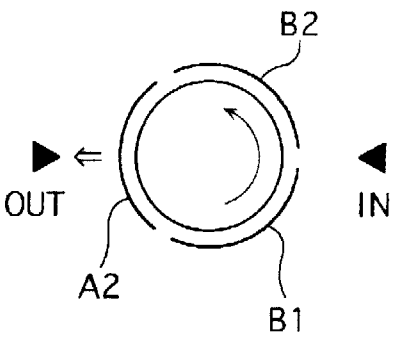
FIG.14(C) PRIOR ART
Figure 14D:
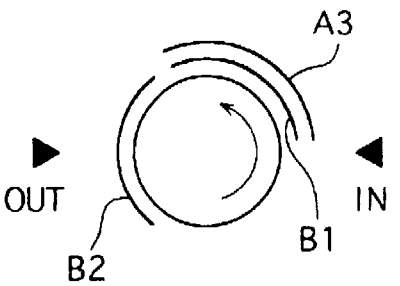
FIG.14(D) PRIOR ART
Figure 14E:
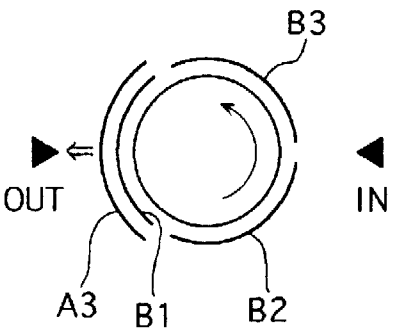
FIG.14(E) PRIOR ART
Figure 14F:
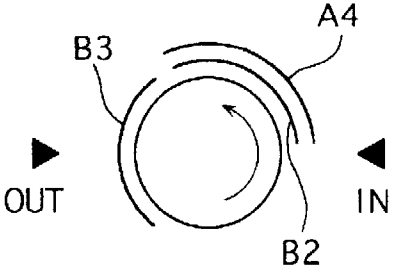
FIG.14(F) PRIOR ART
Figure 15:
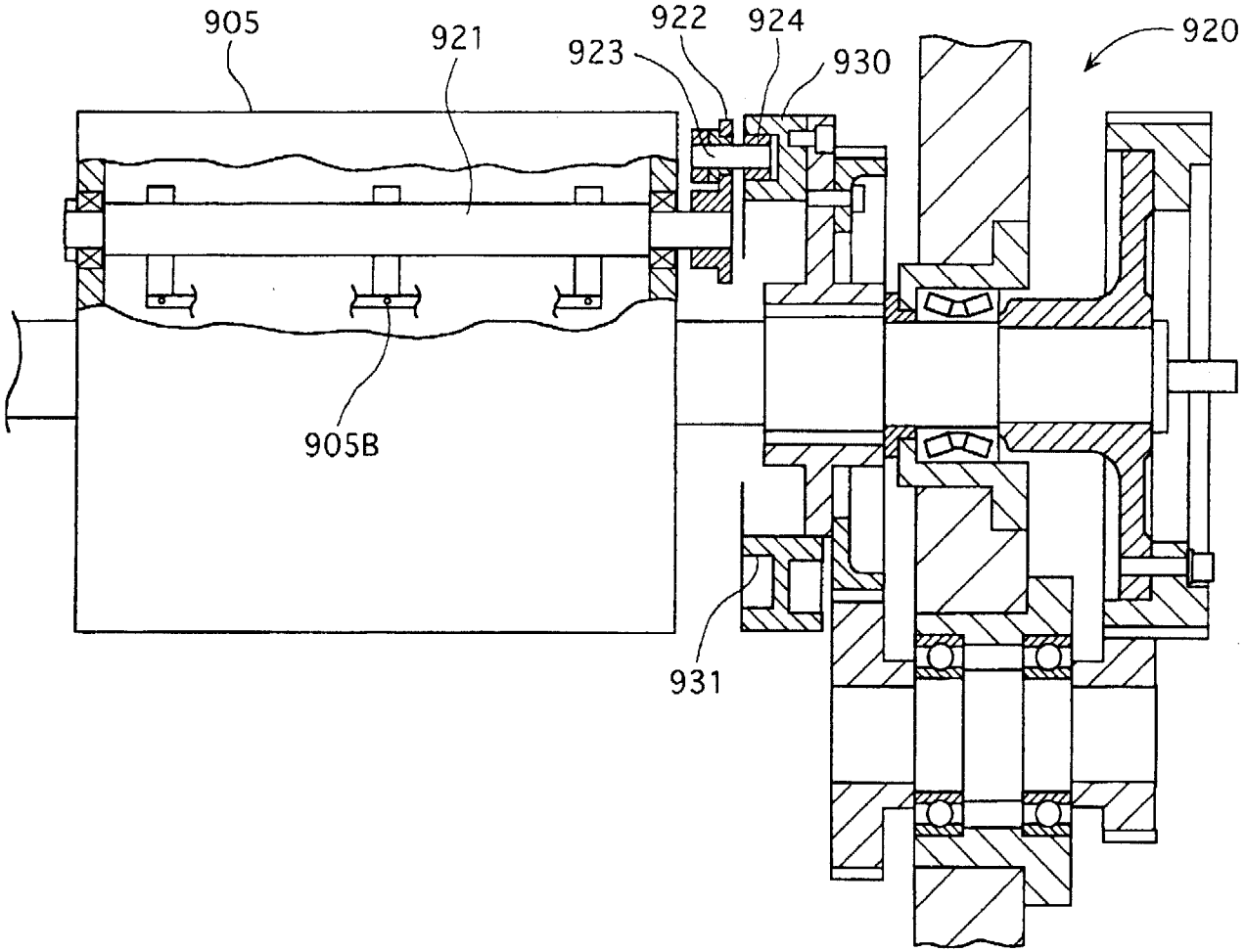
FIG. 15 PRIOR ART
FIG. 15 is a fragmentary section view of the first conventional example.
Figure 16A:
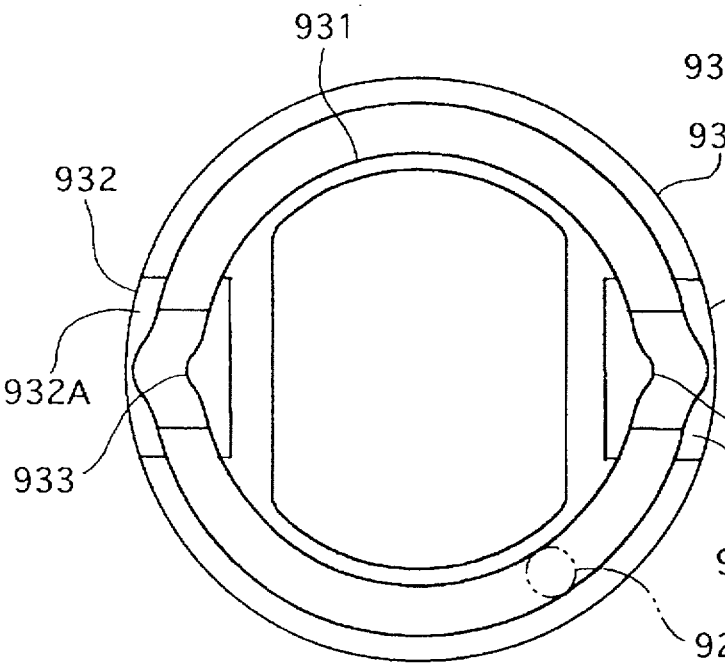
FIG.16(A) PRIOR ART
FIG. 16 is an explanatory diagram of the state of rotating cam in the non-collection mode in the first conventional example.
Figure 16B:
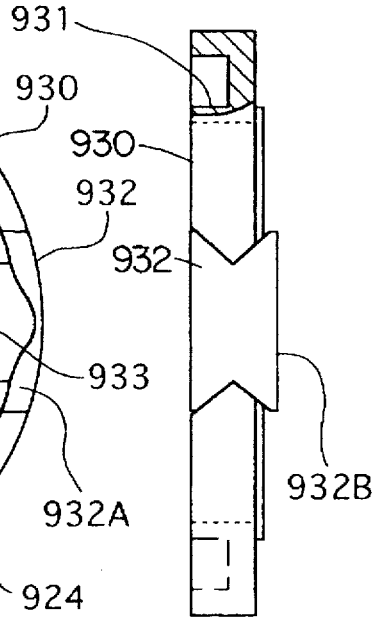
FIG.16(B) PRIOR ART
Figure 17:
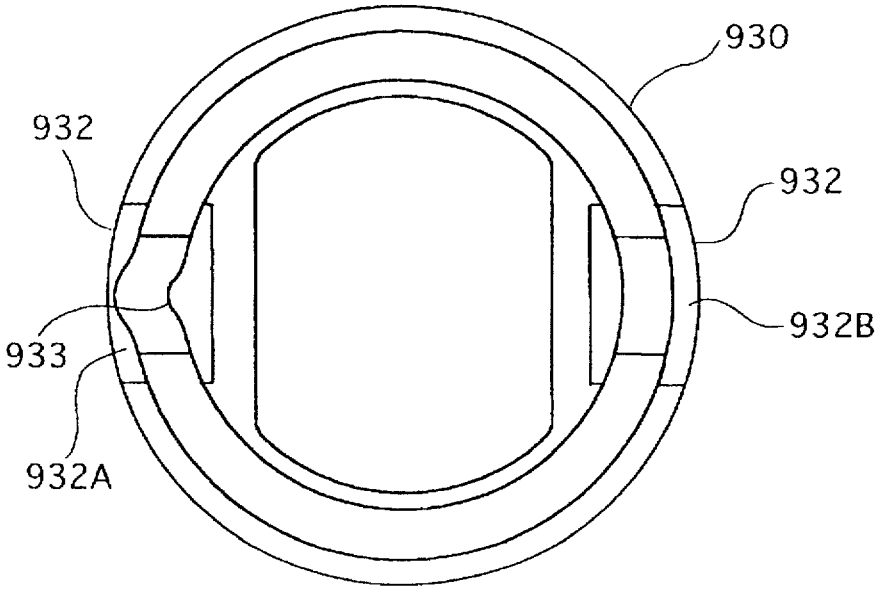
FIG.17 PRIOR ART
FIG. 17 is an explanatory diagram of the state of rotating cam in the collection mode in the first conventional example.
Figure 18:
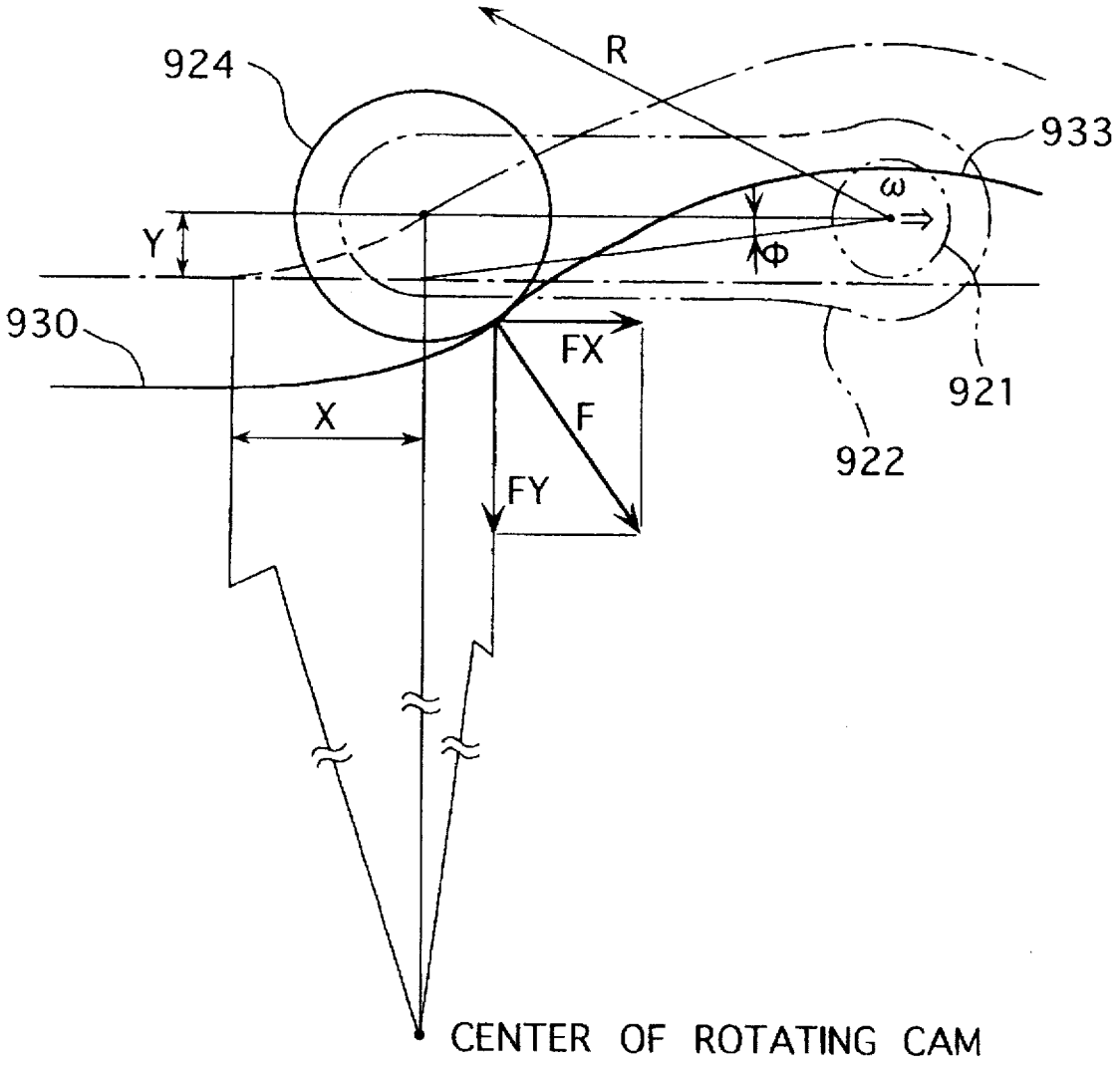
FIG. 18 PRIOR ART
FIG. 18 is an explanatory diagram on occasion the cam follower passes through the cam protuberance in the first conventional example.
Figure 19:
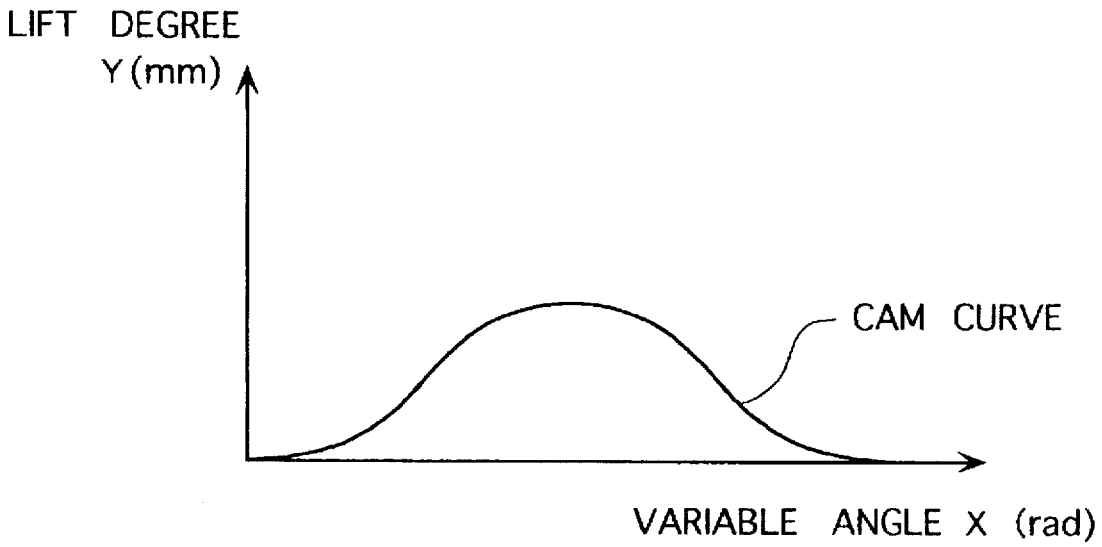
FIG. 19 PRIOR ART
FIG. 19 is an explanatory diagram of the changing form of cam curve in the first conventional example.
Figure 20:
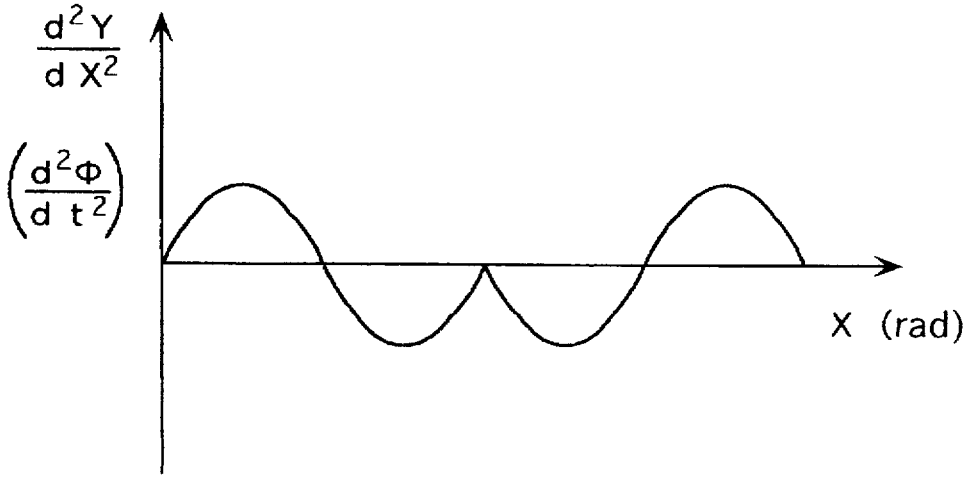
FIG. 20 PRIOR ART
FIG. 20 is an explanatory diagram of the rotation angular acceleration of cam roller lever in the first conventional example.

Referring now to FIG. 1, the folding machine with collection mechanism 10 has almost the same structure as the folding machine with collection mechanism 900 of the first conventional instance in FIG. 13 and includes, depicting direction from the upper reaches (the right of drawing) to the lower reaches (the left of drawing) of a printed paper flow, a cutting cylinder 13 having two cutting blades 13A to cut a printed paper 12 which is alternately and continuously printed in two sort of a pattern A and a pattern B, a paper pin cylinder 14 having a 2-line pin 14A, a collection cylinder 15 having a 3-line pin 15B (located a 120° angle) and three tucker blades 15A (located a 120° angle), a gripper cylinder 16 having a 6-line gripper 16A (located a 60° angle) and up and down slowdown cylinders 17,18. Circumstantial explanations are omitted because respective basic movements of cylinders in the folding machine with collection mechanism 10 and the process for the printed paper 12 are the same structure as the folding machine with collection mechanism 900 of the first conventional instance.

The folding machine with collection mechanism 10 is, like the folding machine with collection mechanism 900 of the first conventional instance, constituted of operating alternately a non-collection mode to deliver separately fold section 12A, 12B to the gripper cylinder 16 and a collection mode to deliver the fold section 12A and the fold section 12B as a pile of layered fold section to the gripper cylinder 16 when the tucker blade 15A in the collection cylinder 15 agrees with the gripper 16A in the gripper cylinder 16. The method of processing the pile of layered fold section at the collection mode is comparable to that depicted in FIGS. 14 (A)~14 (F).

At the moment of corresponding the tucker blade 15A in the collection cylinder 15 and the gripper 16A in the gripper cylinder 16, point K in the FIGURES is identified with a location before the pins 15B hook the fold section 12A, 12B thereat, in brief, a location forwardly revolving through a half length from the point of corresponding the tucker blade 15A and the gripper 16A to respective fold section 12A, 12B.

And the folding machine with collection mechanism 10 has a collection mechanism 20 which is a different structure from the collection mechanism 920 in the folding machine with collection mechanism 900 of the first conventional example.

Respective pins 15B in the collection cylinder 15 move in and out in the direction of arrow C in FIG. 1 with rotation of a pin drive shaft 21 and project from the surface as respective fold section 12A, 12B are hooked and disappear from the surface as respective fold section 12A, 12B are delivered to the gripper cylinder 16.

Figure 2:
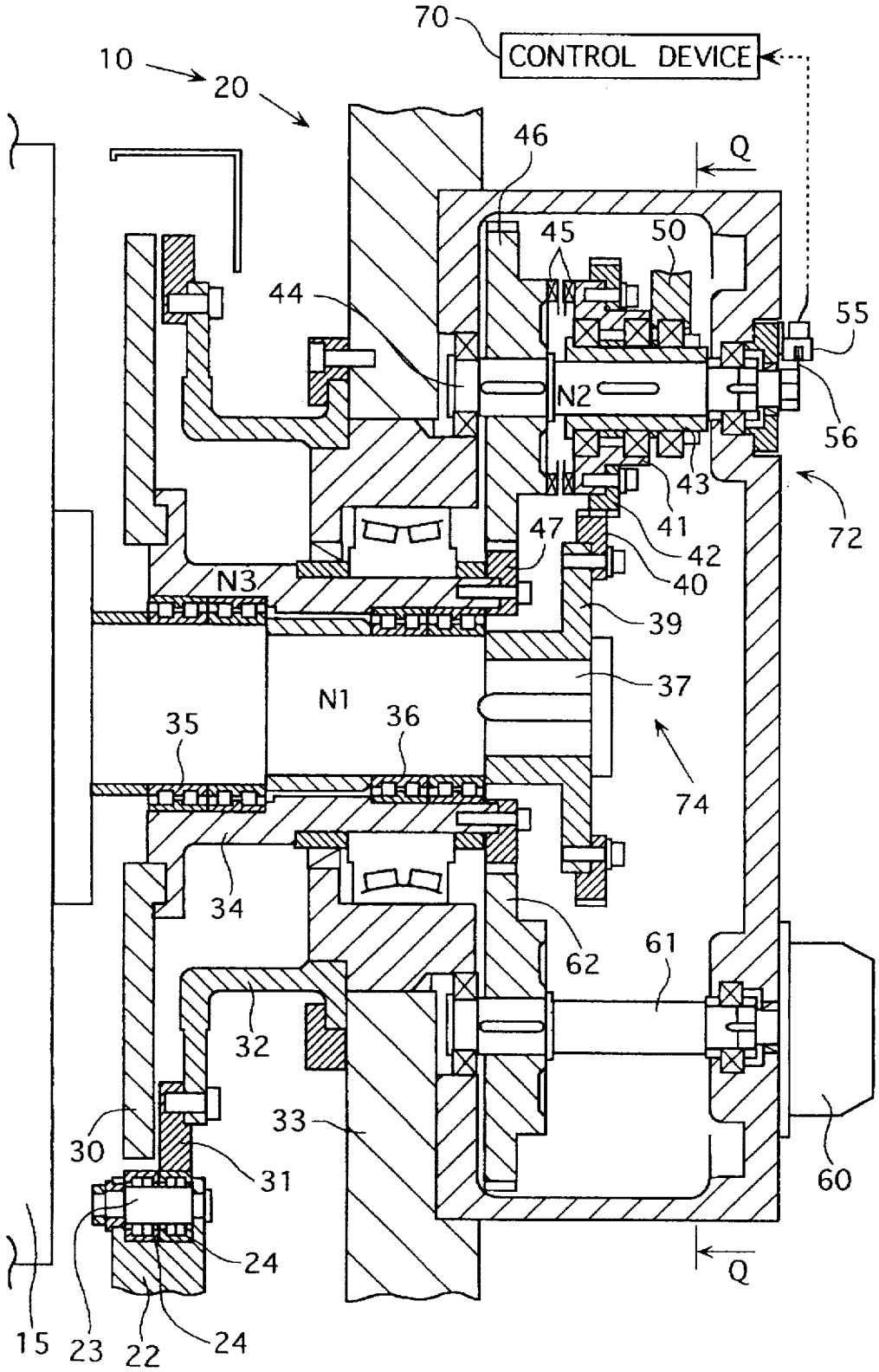
FIG. 2 is a sectional view of the collection mechanism in the first embodiment.
Figure 3:
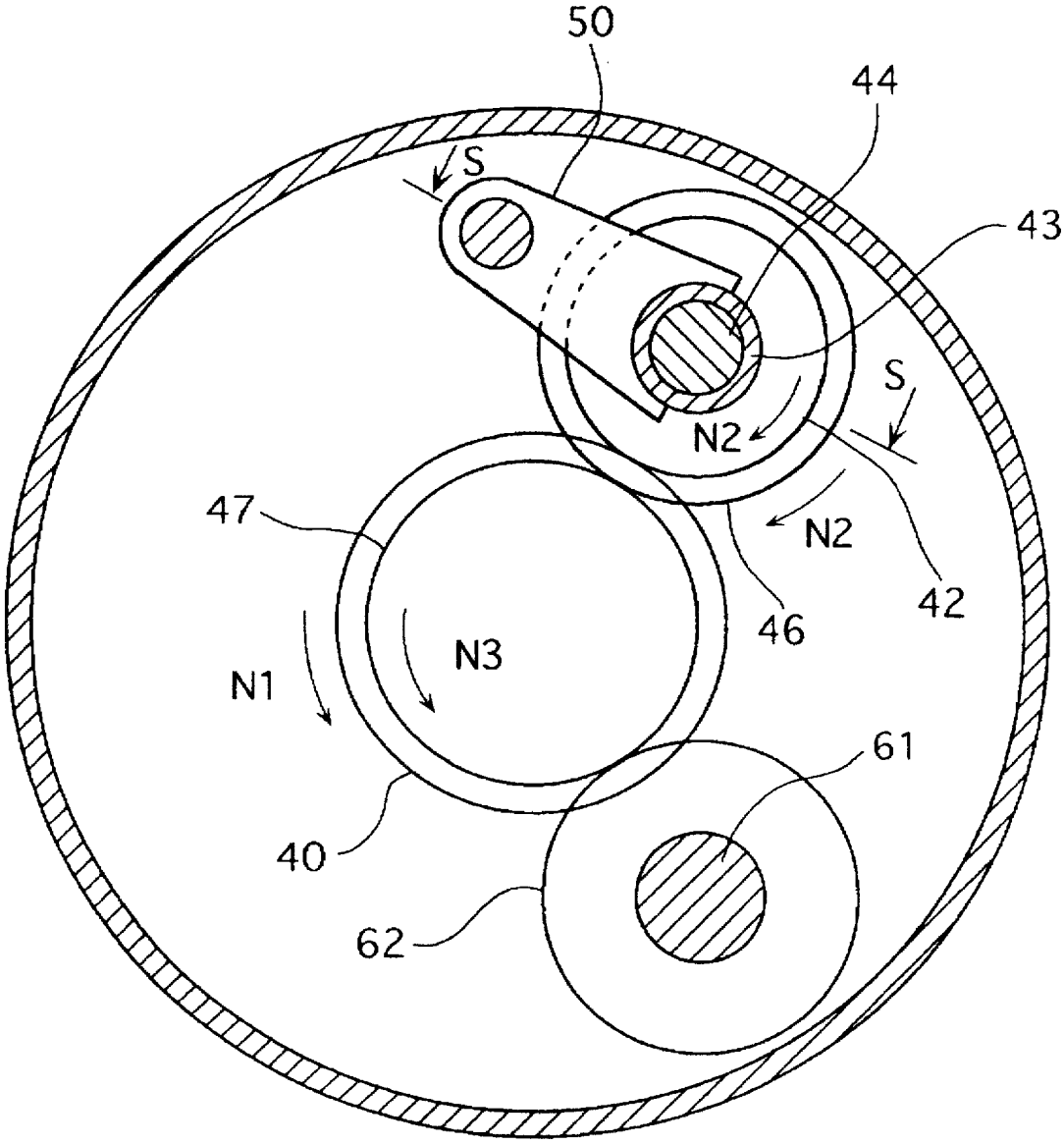
FIG. 3 is a fragmentary sectional view of the collection mechanism in the first embodiment.

FIG. 2 depicts in detail the structure of the collection mechanism 20 to carry out operating control of respective pins 15B in the collection cylinder 15 by pivoting the pin drive shaft 21 and FIG. 3 depicts a sectional view of the collection mechanism 20 which is depicted from the direction of arrow Q in FIG. 2.

Collection mechanism

In FIGS. 1 and 2, the collection mechanism 20 includes a cam roller lever 22 secured to end of the pin drive shaft 21 to pivot thereabout, an associated cam follower 24 capable of rotating the cam roller lever 22 through a cam follower shaft 23, a rotating cam 30 and a fixed cam 31 which guides and contacts the cam follower 24 and a rotating cam drive means 72 to drive the rotating cam 30.

Fixed cam

In FIG. 1, the fixed cam 31 shown as a two-dot chain line therein possesses a recessed portion 31A formed on the predetermined cam profile at a position (thereinafter, a position corresponding to delivering operation KK) on a peripheral portion and a constantly curved portion 31B having regular curvature on other parts of peripheral portion. As the recessed portion 31A passes by the cam follower 24, the pin 15B undergoes the re-projecting action or the disappearing action.

The position corresponding to delivering operation KK located in the recessed portion 31A on the fixed cam 31 corresponds to a point of the cam follower 24 connected to the pin 15B when the pin 15B comes to the delivering operation position (the point K in FIG. 1).

Rotating cam

The rotating cam 30 shown as a two-dot chain line in FIG. 1 comprises a screening portion 30A which is the same shape as a part of the perimeter of the constantly curved portion 31B on the fixed cam 31 and comprises a non-screening portion 30B which has a perimeter lying more inside the peripheral edge portion of the constantly curved portion 31B on the fixed cam 31. As indicated in the drawing, the outside diameter of the screening portion 30A is a bit smaller than the outside diameter of the constantly curved portion 31B of the fixed cam 31 in FIG. 1.

The screening portion 30A on the rotating cam 30 possesses a circumferential width which is capable of screening the recessed portion 31A on the fixed cam 31 when the screening portion 30A on the rotating cam 30 agrees with the recessed portion 31A on the fixed cam 31 as the rotating cam 30 rotates. The pin 15B does not undergo its predetermined re-projecting action nor predetermined disappearing action when the recessed portion 31A is screened by the screening portion 30A.

The non-screening portion 30B on the rotating cam 30 lies radially inside so as not to screen the recessed portion 31A on the fixed cam 31 during rotation of the rotating cam 30. Namely the pin 15 carries out its predetermined re-projecting action or predetermined disappearing action because the complete shape of the cam profile, including the recessed portion 31A, is defined when the non-screening portion 30B on the rotating cam 30 coincides with the recessed portion 31A on the fixed portion 31.

Motion control of the pin 15 for the rotating cam 30 and the fixed cam 31 will be described in FIG. 5 and FIG. 6 later.

Rotating cam drive means

In FIG. 2, the fixed cam 31 is secured with a frame 33 through a fixed cam holder 32.

The rotating cam 30 is fitted under a rotating cam holder 34 and supported pivotal to a collection cylinder shaft 37 through bearing 35, 36 with the rotating cam holder 34.

An end of the collection cylinder shaft 37 is fastened to a gear boss 39, and a first gear 40 is attached for phase adjustment around the gear boss 39.

The first gear 40 is engaged with a second gear 42 fastened to a clutch boss 41. The clutch boss 41 is supported pivotally to a sleeve 43 through a bearing. The sleeve 43 is fitted around the clutch shaft 44 so as to rotate together.

A clutch gear 46 forming a pair of clutches 45 with clutch boss 41 is disposed on clutch shaft 44. The clutch 45 is comprised of a contains one-point clutch having a tooth to connect at predetermined one phase (one position while the clutch boss 41 and the clutch gear 46 turn relatively full circle) between a side of the clutch boss 41 and a side of the clutch gear 46.

The clutch gear 46 is engaged with a rotating cam gear 47 which is attached by screws to the rotating cam holder 34.

Therefore, in the state of connecting clutch 45, rotation of the collection cylinder 15 is transmitted to the collection cylinder shaft 37, the gear boss 39, the first gear 40, the second gear 42 and the clutch boss 41 and then, through the clutch 45, to the clutch gear 46, the rotating cam gear 47, the rotating cam holder 34 and the rotating cam 30, whereby a drive transmission system 74 is structed to cause the collection cylinder 15 and the rotating cam 30 to rotate in interlocking fashion.

The numbers of teeth in the respective gears on this occasion are defined by the ratio of a rotational frequency N2 of second gear 42 to a rotational frequency N1 of first gear 40:

Rotational frequency N2 / Rotational frequency N1=3/2.

The numbers of teeth in the respective gears are defined by, in the state of connecting the clutch 45, the ratio of a rotational frequency N3 of rotating cam gear 47 to the rotational frequency N1 of first gear 40, namely the ratio of the rotational frequency N3 of rotating cam 30 to the rotational frequency N1 of collection cylinder 15 (the rotation rate of rotating cam 30 to the collection cylinder 15):

Rotational frequency N3 / Rotational frequency N1=3/2.

If the collection cylinder 15 turns through 120 degrees (one segment of an interval for the pin 15 arranged), the rotating cam 30 will turn through 180 degrees.

Since the rotational frequency of clutch gear 46 is equal to the rotational frequency N2 of second gear 42 in state of connecting the clutch 45, from the relation to the rotational frequency, the ratio of the rotational frequency N2 of clutch gear 46 to the rotational frequency N3 is Rotational frequency N2 /Rotational frequency N3=1.

The clutch boss 41 on this side of clutch 45 the portion from the collection cylinder 15 to the clutch boss 41 in the drive transmission system 74) is allowed to be connected in the state of optional period, while the clutch gear 46 on other side of the clutch 45 (the portion from the clutch gear 46 to the rotating cam 30 in the drive transmission system 74) is allowed to be connected in predetermined state.

In considering the case where as the clutch boss 41 on this side of clutch 45 is fixed, the rotating cam 30 turns a full circle because of the relation of the rotating frequency N2/the rotating frequency N3=1 during which the clutch gear 46 makes one turn for the clutch boss 41. The clutch boss 41 on this side of the clutch 45 is allowed to be connected in the state of optional period (while the portion from the collection cylinder 15 to the clutch boss 41 in the drive transmission system 74 is considered to fix), while the clutch 45 is allowed to be connected at one point (predetermined phase) during which the rotating cam 30 is turned full circle.

Figure 4:
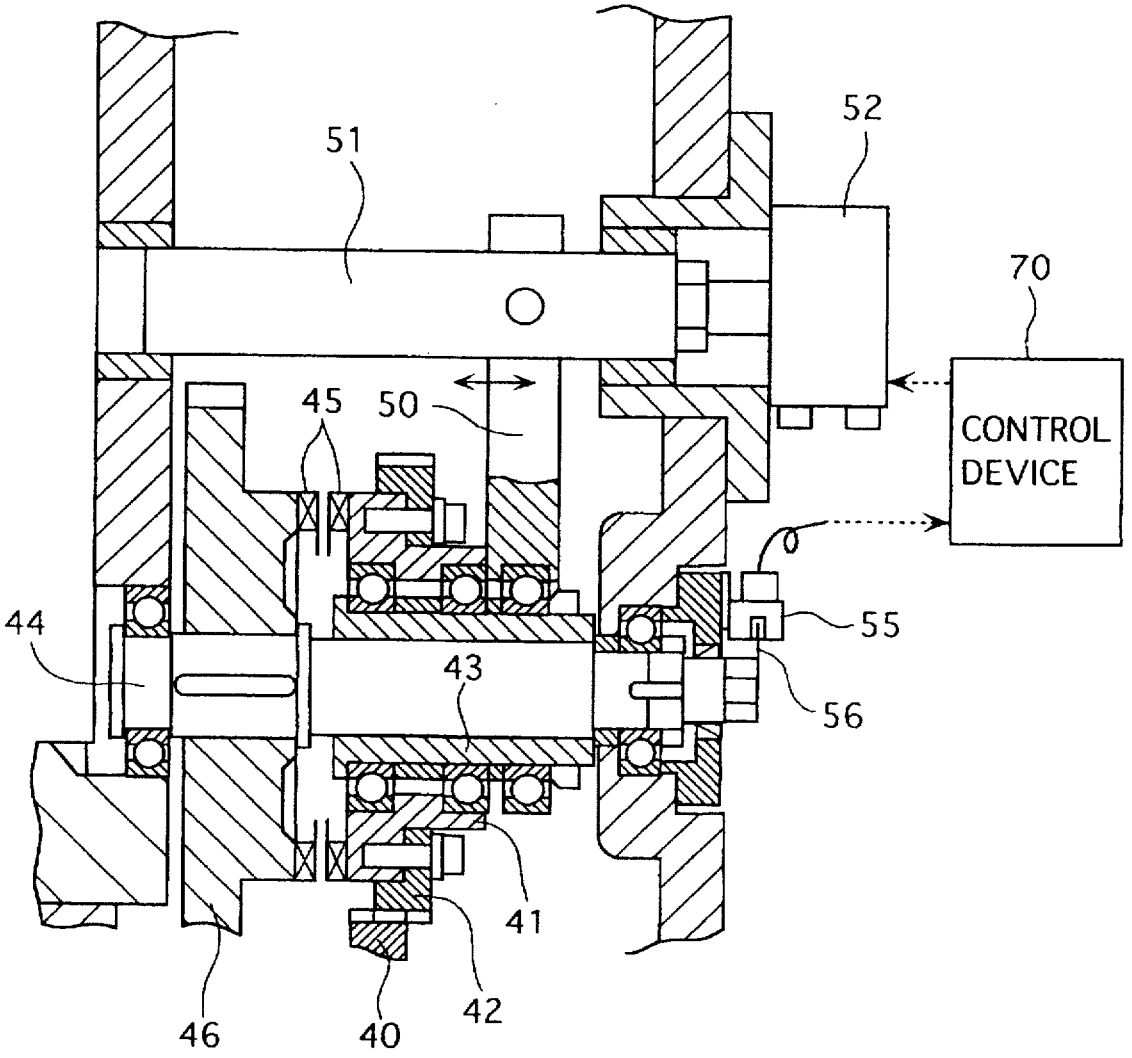
FIG. 4 is another fragmentary sectional view of the collection mechanism in the first embodiment.

FIG. 4 depicts an enlarged sectional view about the clutch 45 taken from the direction of arrow S in FIG. 3.

The sleeve 43 allows shift arm 50 to rotate through a bearing (see FIG. 3) which is structured to effect sliding about the clutch shaft 44 by moving the shift arm 50 axially of the clutch shaft 44.

The shift arm 50 is screwed to a shift shaft 51 placed parallel to the clutch shaft 44 and an air cylinder 52 with a switch which is located at the end of the shift shaft 51.

The ON/OFF control of the clutch 45 is executed ON/OFF via the air cylinder 52 by actuating and breaking operation of a solenoid valve (not shown). As the shift arm 50 and the shift shaft 51 move to the left of FIG. 4 in ON-state of the air cylinder 52, the sleeve 43 moves to the left of FIG. 4 to connect the clutch 45, conversely as the shift arm 50 and the shift shaft 51 move to the right of FIG. 4 in OFF-state of the air cylinder, the sleeve 43 moves to the right of FIG. 4 to cut the clutch 45.

The collection mechanism 20 includes a control device 70 which performs the automatic control of the air cylinder 52 to automatically ON/OFF the clutch 45 and exchange the non-collection mode and the collection mode.

Back to FIG. 2, towards the right end of clutch shaft 44 is located a phase sensing means 55 equipped with a proximity switch which carries out phase detection of the rotating cam 30 by detecting the passing of a piece to be detected 56 located at the end of clutch shaft 44.

The phase sensing means 55 determines stop position of the rotating cam 30 in the non-collection mode, and an output signal thereout is sent into the control device 70. The stop position of the rotating cam 30 is one position per one circle in the rotating cam 30 because, as in the foregoing description, the ratio of the rotational frequency N2 of clutch gear 46 (the rotational frequency N2 of clutch shaft 44) to the rotational frequency N3 of rotating cam gear 47 is the rotational frequency N2/the rotational frequency N3=1.

The phase sensing means might comprise for example, a rotary encoder or other device that can detect the phase of rotating cam 30.

The lower right of FIG. 2 depicts a brake 60 assigned as a stationary means which possess a brake shaft 61 to which is fixed a brake gear 62 meshing with the rotating cam gear 47.

The brake 60 is used to hold the rotating cam 30 fixed at a predetermined position out of interlock with the collection cylinder 15 as the clutch 45 is disengaged.

A rotational frequency of the brake shaft 61 is optional if a brake torque capacity can be satisfyingly supplied. The brake 60 is optionally chosen from brakes having the capacity for ON/OFF control, for example an air brake, a solenoid brake and so on.

The rotating cam drive means 72 is composed, as in the foregoing description, of respective parts of the drive transmission system 74, the phase sensing means 55, the brake 60 as the stationary means and the control device 70.

In the first embodiment, the following are the motion control of the pin 15B in the collection cylinder 15.

Figure 5:
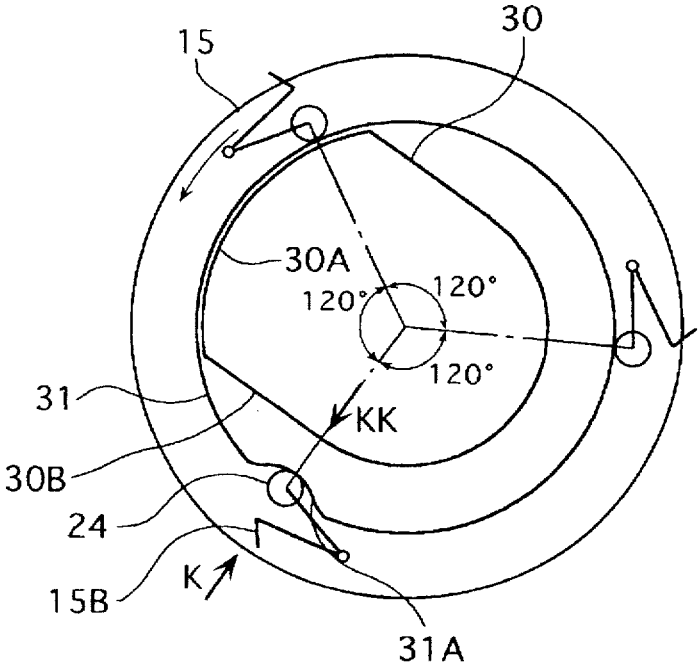
FIG. 5 is an explanatory diagram of relation of the rotating cam and the fixed cam in the non-collection mode in the first embodiment.
Figure 6:
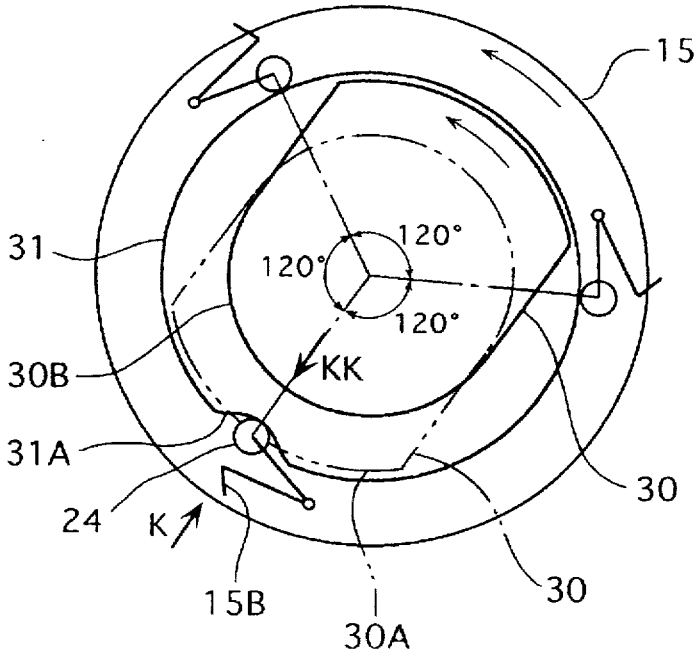
FIG. 6 is an explanatory diagram of relation of the rotating cam and the fixed cam in the collection mode in the first embodiment.

FIG. 5 depicts a motion relation between the rotating cam 30 and the fixed cam 31 in the non-collection mode exhausting the fold section 12A, 12B one by one as the non-layered fold section in non-piled state, and FIG. 6 depicts a motion relation between the rotating cam 30 and the fixed cam 31 in the collection mode exhausting the fold section 12A, 12B as the layered fold section in two piled state.

Non-collection mode

The clutch 45 assumes the OFF-state and the rotating cam 30 becomes interrupted in the non-collection mode in FIG. 5.

When the cam follower 24 reaches the position corresponding to delivering operation KK (when the pin 15B reaches the delivering operation position K) of the rotating cam 30 shown with the solid line in the drawing, the non-screening portion 30B is positioned at the position corresponding to delivering operation KK and the recessed portion 31A in the fixed cam 31 is non-screening condition.

And then the collection cylinder 15 turns 120 degrees, and when next cam follower 24 reaches the position corresponding to delivering operation KK (when next pin 15B reaches the delivering operation position K), the rotating cam 30 is in the solid line position in the drawing because of the interrupting state and the recessed portion 31A in the fixed cam 31 is held to the non screening condition.

Consequently, every time when the pin 15B reaches the delivering operation position K, the pin 15B undergoes the re-projecting action and the disappearing action and respective fold section 12A, 12B is delivered to the gripper cylinder 16 as the non-layered fold section in non-piled state.

The position of the rotating cam 30 shown with in solid lines in the drawing is one example of the stop position of the rotating cam 30 and is an optional position as long as the recessed portion 31A in the fixed cam 31 is under the circumstance of non-screening.

Collection mode

On the other hand, in the collection mode showed FIG. 6, tie clutch 45 is activated to the ON-state and both the rotating cam 30 and the collection cylinder 15 turn toward the same direction (counter-clockwise). The rate of the rotation of cam 30 to the collection cylinder 15 is 3/2.

When the cam follower 24 reaches the position corresponding to delivering operation KK (when the pin 15 reaches the delivering operation position K), the non-screening portion 30B is positioned at the position corresponding to delivering operation KK and the recessed portion 31A in the fixed cam 31 is conditioned on non-screening, while the rotating cam 30 is assigned as shown in solid lines in the drawing. And then the collection cylinder 15 turns 120 degrees, and when the next cam follower 24 reaches the position corresponding to delivering operation KK (when next pin 15B reaches the delivering operation position K), the rotating cam 30 assumes the position of the two-dot chain line in the drawing due to turning 180 degrees, and then the screening portion 30A is positioned at the position corresponding to delivering operation KK and the recessed portion 31 A in the fixed cam 31 becomes screened.

Due to a repeat of the foregoing description, when the pin 15B reaches the delivering operation position K, every two times the pins 15B undergo the re-projecting action and the disappearing action, the respective fold sections 12A, 12B are delivered to the gripper cylinder 16 as the pile layered fold section.

Mode change

The following is a description of the change-over operation between the collection mode and the non-collection mode.

Figure 7:
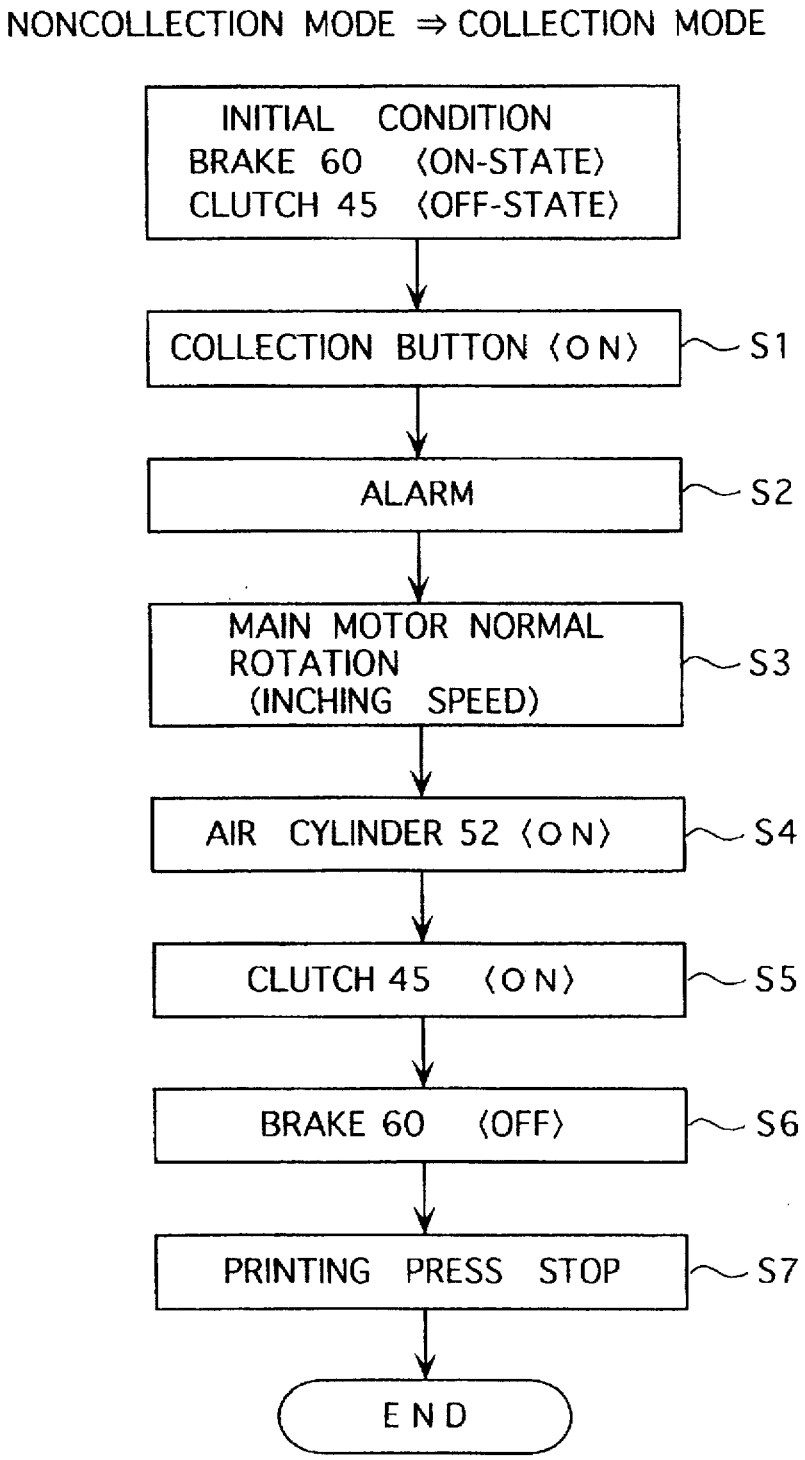
FIG. 7 is a flow chart of automatic changeover from the non-collection mode to the collection mode in the first embodiment.
Figure 8:
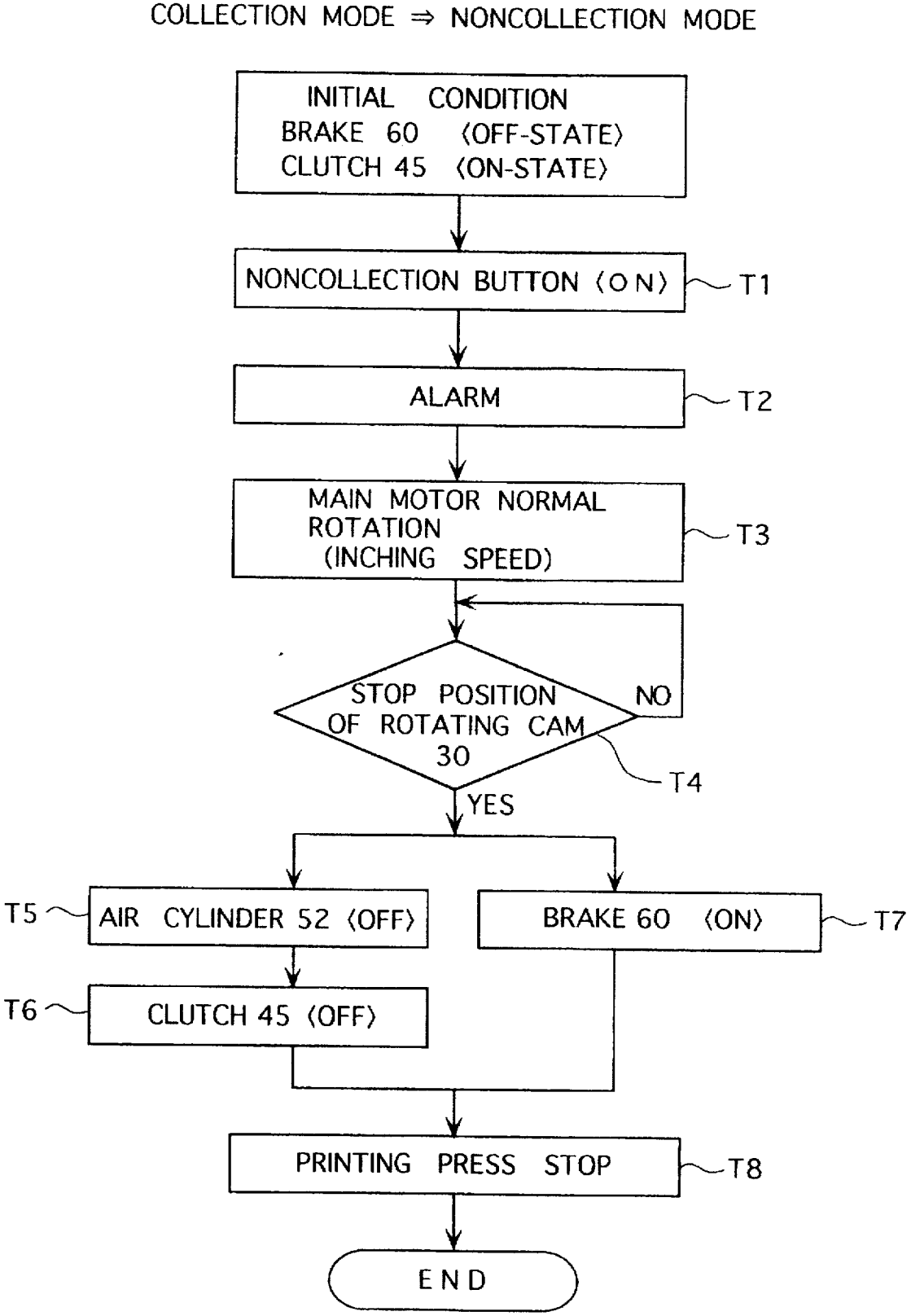
FIG. 8 is a flow chart of automatic changeover from the collection mode to the non-collection mode in the first embodiment.

FIG. 7 and 8 depict a sequence to operate automatically the change-over operation memorized in the control device 70. More particularly, FIG. 7 depicts a sequence for changing from the non-collection mode to the collection mode and FIG. 8 depicts a sequence for changing from the collection mode to the non-collection mode.

From the non-collection mode to the collection mode

In FIG. 7, since an initial condition is applied to a driving state in the non-collection mode, the clutch 45 is assigned to the OFF-state and the brake 60 is assigned to the ON-state to hold fixedly the interrupting of rotating cam 30 at a predetermined position.

First, a collection button (not shown) located away from the rotating cam 30 switches on an order to initiate the change-over operation from the non-collection mode to the collection mode (Step S1).

Next, an alarm is sounded to start the change-over operation (Step S2), the collection cylinder 15 is turned to cause a main motor in the printing press to carry out a normal rotation at inching speed (Step S3).

And the air cylinder 52 assumes the ON-state by operating the solenoid valve (Step S4), the rotating cam 30 and the collection cylinder 15 are connected in relation to the predetermined phase shown in FIG. 6 after engaging the clutch 45 (Step S5), and the rotating cam 30 is removed from the fixed holding state when the brake 60 assumes the OFF-state (Step S6).

Finally, the printing press is stopped by stopping the normal rotation of the main motor, and the change-over operation from the non-collection mode to collection mode is completed.

From the collection mode to the non-collection mode

In FIG. 8, since an initial condition is applied to a driving state in the collection mode, the rotating cam 30 is connected with the collection cylinder 15, the clutch 45 is assigned to the ON-state and the brake 60 is assigned to the OFF-state.

A non-collection button (not shown) adjacent to the collection button is switched on in order to initiate the change-over operation from the collection mode to the non-collection mode (Step T1).

An alarm in sounded for starting the change-over operation (Step T2), the main motor of the printing press makes the normal rotation in inching speed so as to rotate of the collection cylinder 15 and the rotating cam 30 (Step T3). The rotating cam 30 is turned until reaching the predetermined stop position shown in FIG. 5 (Step T4).

When the rotating cam 30 reaches the predetermined stop position, the air cylinder 52 assumes the OFF-state by operating the solenoid valve (Step T5), connection between the rotating cam 30 and the collection cylinder 15 is canceled by disengaging the clutch 45 (Step T6) and concurrently the rotating cam 30 is held at the predetermined stop position for the brake 60 assumes the ON-state (Step T7).

Finally, the printing press is stopped by stopping the normal rotation of the main motor (Step T8), and the change-over operation from the collection mode to the non-collection mode ends.

Following are advantages of the first embodiment.

The recessed portion 31A forming the cam profile is formed in the fixed cam 31 but the rotating cam 30 and counterforce which the rotating cam 30 receives from the cam follower 24 behaves only radially with respect to the rotating cam 30, so that load deviation like the first and second conventional example does not occur in a drive system of the rotating cam 30 and thence the possibility of encountering load deviation can be canceled. Therefore, the rotating cam 30 can be stably rotated and non-uniform revolution on respective cylinders such as the collection cylinder 15, the gripper cylinder 16 and others connecting with the rotating cam 30 can be controlled, so that cutting accuracy and folding accuracy in the fold section 12A, 12B can be increased.

Also, cutting accuracy and folding accuracy in the fold section 12A, 12B can be fully obtained even though machine speed is high.

Machine life can be prolonged by preventing fatigue which develops from by alternate repeating loads of respective gears teeth in which the first gear 40, the second gear 42, the clutch gear 46, the rotating cam gear 47 and others composing the drive system for the rotating cam 30.

The change-over operation can be easily operated and can shorten necessary operating hours because respective modes are changed by the rotating cam 30 which is turned at the rotation rate 3/2 to the collection cylinder 15 in the collection mode, and by the rotating cam 30 which stopped at the position which the screening portion 30A does not screen the recessed portion 31A in the fixed cam 31 in the non-collection mode.

The collection mode and the non-collection mode are changed with a simple mechanism comprised of two cams which are the rotating cam 30 and the fixed cam 31.

The brake 60 as the stationary means causes the rotating cam 30 to hold surely at the state of interruption in the non-collection mode, and prevents the rotating cam 30 from moving by oscillation or others ways.

An operator's burden can be eased because the clutch 45 is located in the drive transmission system 74 between the collection cylinder 15 and the rotating cam 30 and the air cylinder 52 causes the clutch 45 to operate ON/OFF as a separate mechanism from the drive transmission system to change between respective modes.

The rotating cam 30 is stopped at the predetermined stop position based on the output signal of the phase sensing means 55 due to the mounting of the phase sensing means 55 monitoring the phase of rotating cam 30.

The control device 70 is provided for automatically changing respective modes by controlling the air cylinder 52, so that the operator's burden can be even more lessened and also the time for changing can be shortened well.

Figure 9:
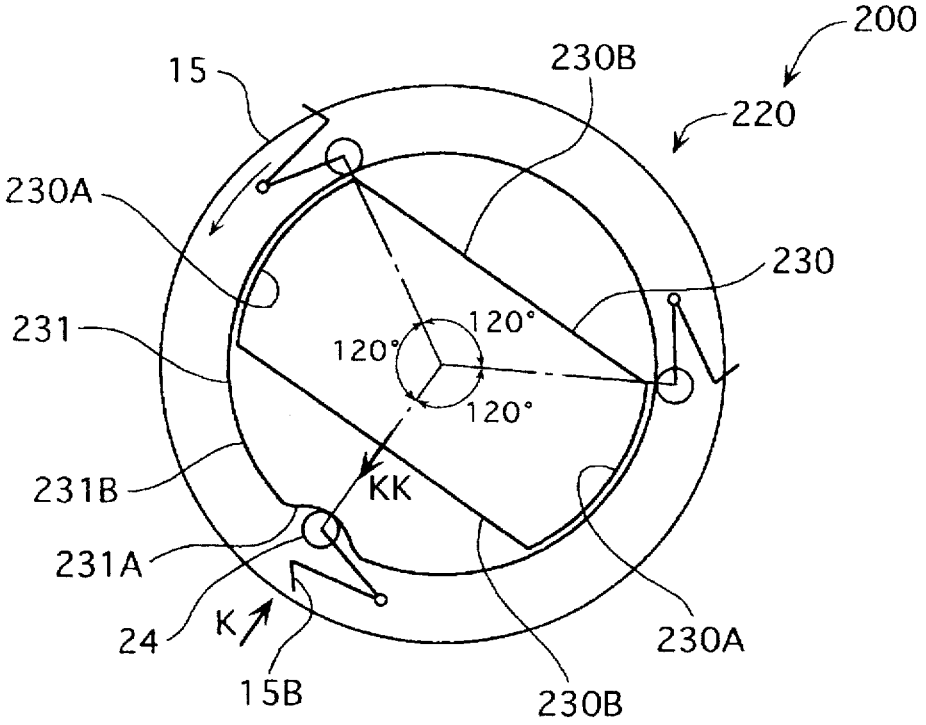
FIG. 9 is an explanatory diagram of relation of the rotating cam and the fixed cam in the non-collection mode in the second embodiment of the present invention.
Figure 10:
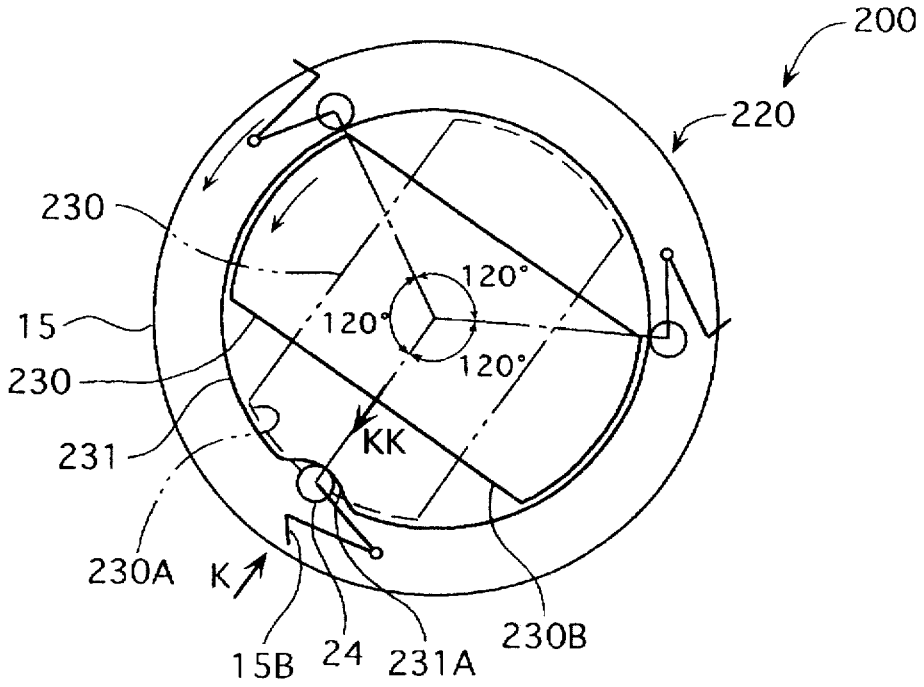
FIG. 10 is an explanatory diagram of relation of the rotating cam and the fixed cam in the collection mode in the second embodiment.

FIG. 9 and 10 depict a folding machine with collection mechanism 200 relating the second embodiment in the present invention.

The folding machine with collection mechanism 200 has relatively the same structure as the folding machine with collection mechanism 10 of the first embodiment, so the detailed explanation is omitted while using the same symbols for the same parts.

The folding machine with collection mechanism 200 is provided the same collection cylinder 15 having the 3-line pin 15B (located a 120° angle) as the folding machine with collection mechanism of the first embodiment, and a different structure of a collection mechanism 220 from the collection mechanism 20 of the first embodiment.

The collection mechanism 220 is provided the same configuration of fixed cam 231 as the fixed cam 31 in the collection mechanism 20 of the first embodiment, and a different configuration of rotating cam 230 from the rotating cam 30 of the first embodiment.

Rotating cam and the fixed cam

In FIG. 9 and 10, the fixed cam 231 is equipped with a recessed portion 231A forming a predetermined cam profile at one position (the position corresponding to delivering operation KK) on the peripheral portion, and the other peripheral portion is formed as a constantly curved portion 231B having definite curvature.

The rotating cam 230 comprises a screening portion 230A having the same outside diameter as the constantly curved portion 231B on the fixed cam 231 at two symmetrical points on the peripheral portion, and the other peripheral portion is assigned as the non-screening portion 230B having a peripheral edge portion located inwardly of the peripheral edge portion of the constantly curved portion 231B on the fixed cam 231.

As shown in the drawing, the outside diameter of the screening portion 230A is a bit smaller than the outside diameter of the constantly curved portion 231B of the fixed cam 231 in the drawing.

The collection mechanism

The collection mechanism 220 possesses almost the same structure as shown in FIG. 2 but the only part different is the ratio of the rotational frequency of respective gears.

In FIG. 2, the number of teeth in respective gears on occasion are defined by the ratio of a rotational frequency N2 of second gear 42 to a rotational frequency N1 of first gear 40:

Rotational frequency N2/Rotational frequency N1=3/4 or 6/4

The number of teeth in respective gears are by in the state of connecting the clutch 45, the ratio of a rotational frequency N3 of rotating cam gear 47 to the rotational frequency N1 of first gear 40, namely the ratio of the rotational frequency N3 of rotating cam 230 to the rotational frequency N1 of collection cylinder 15 (the rotation rate of the rotating cam 230 to the collection cylinder 15):

Rotational frequency N3 / Rotational frequency N1=3/2

If the collection cylinder 15 turns through 120 degrees (one segment of an interval for the pin 15 arranged), the rotating cam 230 will turn through 90 degrees.

Since the rotation frequency of clutch gear 46 is equal to the rotational frequency N2 of second gear 42 in the state of connecting the clutch 45 from the relation to the rotational frequency, the ratio of the rotational frequency N2 of clutch gear 46 to the rotational frequency N3 of rotating cam gear 47: Rotational frequency N2/Rotational frequency N3=1 or 2.

As in the first embodiment, the clutch 45 contains a one-point clutch having teeth to connect at predetermined one phase (one position during which the clutch boss 41 and the clutch gear 46 turn relatively full circle) between side of the clutch boss 41 and side of the clutch gear 46.

The clutch boss 41 on this side of clutch 45 (the portion from the collection cylinder 15 to the clutch boss 41 in the drive transmission system 74) is allowed be connected in one state of an optional period, while the clutch gear 46 on other side of clutch 45 (the portion from the clutch gear 46 to the rotating cam 230 in the drive transmission system 74) is allowed to be connected in predetermined one state of two states.

If the clutch boss 41 on this side of the clutch 45 is considered as being fixed, when the clutch gear 46 makes one turn for the clutch boss 41, the rotating cam 230 turns a full circle in the case where the relation of the rotating frequency N2/the rotating frequency N3=1 and turns a half circle in the case where the rotating frequency N2/the rotating frequency N3=2.

In the latter where, rotational frequency N2/the rotating frequency N3=2, the clutch 45 can be connected although the clutch gear 46 turns more a than full circle for the clutch boss 41 and the rotating cam 230 turns more than a half circle, so that the clutch 45 becomes connected at two points (different predetermined two phase each other) when the rotating cam 230 is turned a full circle. Because the configuration of rotating cam 230 is assigned as a geometric, symmetrical configuration with respect to the rotational axis, the condition is not changed even though the rotating cam 230 is turned a half circle.

In the former rotational frequency N2/the rotational frequency N3=1, as in the first embodiment, the clutch 45 is connected at one point (predetermined phase)/when the rotating cam 230 turns a full circle.

In the non-collection mode defined by the phase sensing means 55, the stop positions of the rotating cam 230 are one or two points per full circle of the rotating cam 230 for the reason that, as in the foregoing description, the ratio of the rotational frequency N2 of clutch gear 46 (the rotational frequency N2 of clutch shaft 44) to the rotational frequency N3 of rotating cam gear 47 is equal to the rotational frequency N2/the rotational frequency N3=1 or 2.

Following is the action control of the pin 15B in the collection cylinder 15 in the second embodiment.

FIG. 9 depicts the action relation between the rotating cam 230 and the fixed cam 231 in the non-collection mode to exhaust respective fold section 12A, 12B one by one as the non-piled, non-layered fold section, and FIG. 10 depicts the action relation between the rotating cam 230 and the fixed cam 231 in the collection mode to exhaust respective fold section 12A, 12B as the piled layered fold section in two piled state.

Non-collection mode

In the non-collection mode depicted in FIG. 9, the clutch 45 assumes the OFF-state and the rotating cam 230 is interrupted.

When the cam follower 24 reaches the position corresponding to delivering operation KK (when the pin 15B reaches the delivering operation position K), the non-screening portion 230B is positioned at the position corresponding to delivering operation KK for the rotating cam 230 shown in the solid lines in the drawing and the recessed portion 230B in the fixed cam 231 is not screened.

Therefrom, when next cam follower 24 reaches the position corresponding to delivering operation KK (when next pin 15B reaches the delivering operation position K) after the collection cylinder 15 makes a 120 degree turn, the interrupting rotating cam 230 holds the state of solid line in the drawing, hence the recessed portion 231A in the fixed cam 231 remains non-screened.

Consequently, every time the pin 15B reaches the delivering operation position K, the pins 15B undergo the re-projecting action and the disappearing action and respective fold section 12A, 12B are delivered to the gripper cylinder 16 as the non-piled, non-layered fold section.

The position of the rotating cam 230 shown with the solid line in the drawing is one example of the stop position of the rotating cam 230 and is an optional position as long as the recessed portion 231A in fixed cam 231 is under the circumstance of non-screening.

The collection mode

On the other hand, in the collection mode shown in FIG. 10, the clutch 45 assumes ON-state and the rotating cam 230 and the collection cylinder 15 revolve in the same direction (counter-clockwise). The rotation rate of rotating cam 230 to the collection cylinder 15 is 3/4.

When the cam follower 24 reaches the position corresponding to delivering operation KK (when the pin 15B reaches the delivering operation position K), the non-screening portion 230B is positioned at the position corresponding to delivering operation KK for the rotating cam 230 shown with the solid line in the drawing, the recessed portion 231A in the fixed cam 231 is not screened.

Therefrom, when the collection cylinder 15 makes a 120 degree turn and next cam follower 24 reaches the position corresponding to delivering operation KK (when next pin 15 reaches the delivering operation position K), the rotating cam 230 assumes the position represented by the two-dot chain line in the drawing due to a turn of 90 degrees, and in above state, the screening portion 230A is positioned at the position corresponding to delivering operation KK and the recessed portion 231A in the fixed cam 231 becomes screened.

Owing to a repeat of the foregoing description, when the pin 15B reaches the delivering operation position K, every two times the pins undergo the re-projecting action and the disappearing action, and respective fold sections 12A, 12B are delivered to the gripper cylinder 16 as the pile layered fold section.

The change-over operation between the collection mode and the non-collection mode is automatically practiced by a process shown in the flow charts of FIG. 7 and 8 like the first embodiment.

The capacities in the second embodiment, similar to the first embodiment, are effective to protect from the load deviation originating in the drive system in the rotating cam 230, improve the cutting accuracy and the folding accuracy in the fold section 12A, 12B, extend machine life, facilitate the change-over operation and shorten the changing time and also because the rotating cam 230 has screening portion 230A at two symmetrical points on the peripheral portion, the clutch 45 can be structured to connect with the rotating cam 230 at predetermined one phase in accordance with the optional one state for the collection cylinder 15, and to connect with the rotating cam 230 at predetermined two phases for a 180 degree phase in accordance with the optional one state for the collection cylinder 15.

Figure 11:
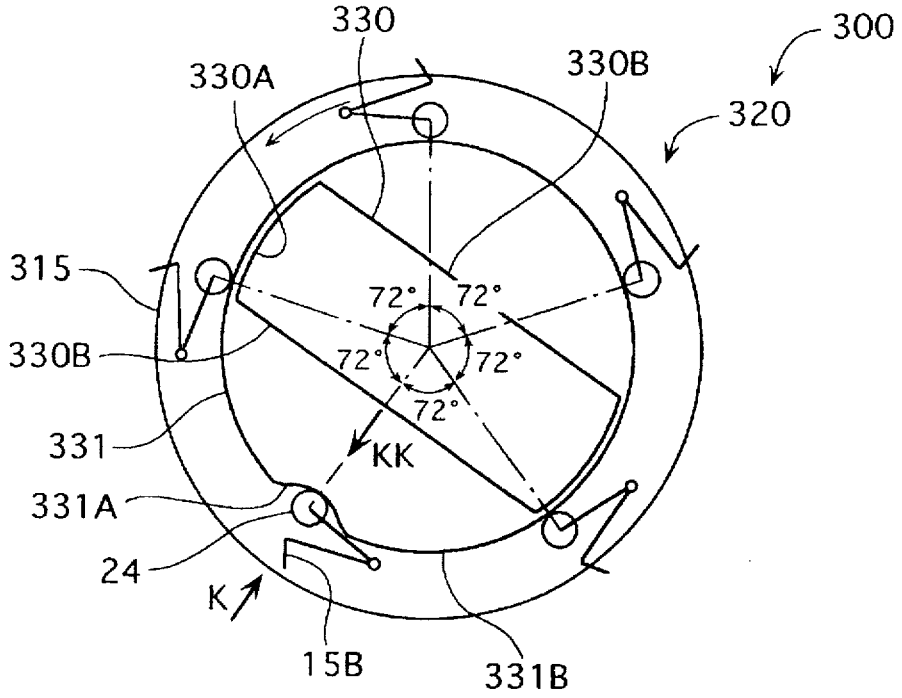
FIG. 11 is an explanatory diagram of relation of the rotating cam and the fixed cam in the non-collection mode in the third embodiment of the present invention.
Figure 12:
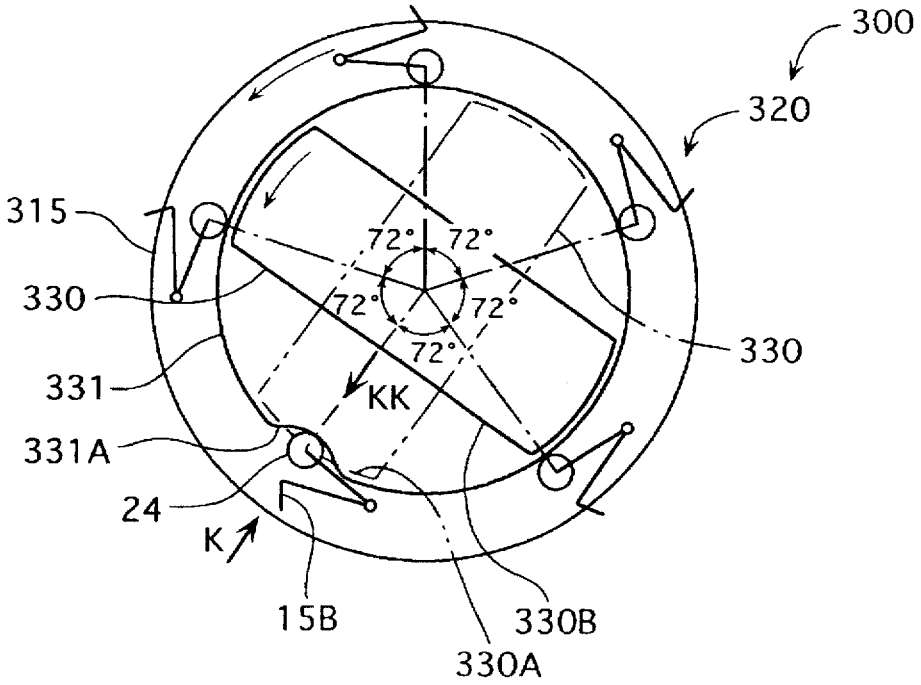
FIG. 12 is an explanatory diagram of relation of the rotating cam and the fixed cam in collection mode in the third embodiment.

FIG. 11 and 12 depict a folding machine with collection mechanism 300 relating the third embodiment of the present invention.

The folding machine with collection mechanism 300 has the almost same structure as the folding machine with collection mechanism 10 in the first embodiment, and has a different structure of the collection mechanism and the number of pin's line arranged in the collection cylinder, so that detailed explanation is omitted while using the same symbols for the same parts.

The folding machine with collection mechanism 300 is provided a collection cylinder 315 having a 5-line pin 15B (located at a 72 degree angle) which is a different structure from the collection cylinder.15 in the first embodiment, and a collection mechanism 320 which is a different structure from the collection mechanism 20 in the first embodiment.

The collection mechanism 320 includes a fixed cam 331 which is the same configuration as the fixed cam 31 in the collection mechanism 20 of the first embodiment, and includes a rotating cam 330 which is the same configuration as the rotating cam 30 of the first embodiment.

Rotating cam and the fixed cam

In FIGS. 11 and 12, the fixed cam 331 is equipped a recessed portion 331A forming a predetermined cam profile at one position (the position corresponding to delivering operation KK) on the peripheral portion, and the other peripheral portion is formed as a constantly curved portion 331A having definite curvature.

The rotating cam 330 comprises a screening portion 330A having the same outside diameter as the constantly curved portion 331B on the fixed cam 331 at two symmetrical two points on the peripheral portion, and the peripheral portion is assigned as the non-screening portion 330B having a peripheral edge portion located inwardly of the peripheral edge portion of the constantly curved portion 331B on the fixed cam 331. As shown in the drawing, the outside diameter of the screening portion 330A is a bit smaller than the outside diameter of the constantly curved portion 331B of the fixed cam 331 in the drawing.

The collection mechanism

The collection mechanism 320 possesses almost the same structure as shown in FIG. 2 but the only part different is the ratio of the rotational frequency of respective gears.

In FIG. 2, the numbers of teeth in respective gears are defined by the ratio of a rotational frequency N2 of second gear 42 to a rotational frequency N1 of first gear 40:

Rotational frequency N2/Rotational frequency N1=5/4 or 10/4.

The numbers of teeth in respective to gears are defined by, in state of connecting the clutch 45, the ratio of a rotational frequency N3 of rotating cam gear 47 to the rotational frequency N1 of first gear 40, namely the ratio of the rotational frequency N3 of rotating cam 330 to the rotational frequency N1 of collection cylinder 15 (the rotation rate of the rotating cam 330 to the collection cylinder 15). Rotational frequency N3 / Rotational frequency N1=5/4

If the collection cylinder 315 turns through 72 degrees (one segment of an interval for the pin 15 arranged), the rotating cam 330 will turn through 90 degrees.

Since the rotation frequency of clutch gear 46 is equal to the rotational frequency N2 of second gear 42 in state of connecting clutch 45, from the relation to the rotational frequency, the ratio of the rotational frequency N2 of clutch gear 46 to the rotational frequency N3 of rotating cam gear 47 is Rotational frequency N2/Rotational frequency N3=1 or 2.

Like in the first and second embodiments, the clutch 45 contains a one-point clutch having teeth to connect at predetermined one phase (one position during the clutch boss 41 and the clutch gear 46 turn relatively full circle) between side of the clutch boss 41 and a side of the clutch gear 46.

Like in the second embodiment, the clutch boss 41 on this side of the clutch 45 (the portion from the collection cylinder 15 to the clutch boss 41 in the drive transmission system 74) allows to be connected in one state of an optional period, while the clutch gear 46 on other side of the clutch 45 (the portion from the clutch gear 46 to the rotating cam 330 in the drive transmission system 74) is allowed to be connected in predetermined one state of two states. Because the configuration of rotating cam 330 has the same point geometric, symmetrical configuration with respect to rotational axis as the rotating cam 230 in the second embodiment, the condition is not changed even though the rotating cam 330 is turned a half circle.

Similar to the second embodiment, in the non-collection mode defined by the phase sensing means 55, the stop positions of the rotating cam 330 are one or two points per full circle of the rotating cam 330 for the reason that, as in the foregoing description, the ratio of the rotational frequency N2 of the clutch gear 46(the rotational frequency N2 of the clutch shaft 44) to the rotational frequency N3 of the rotating cam gear 47 is equal to the rotational frequency N2/the rotational frequency N3=1 or 2.

In the third embodiment, the following portion describes motion control of the pin 15B in the collection cylinder 315.

FIG. 11 depicts the action relation between the rotating cam 330 and the fixed cam 331 in the non-collection mode to output respective fold section 12A, 12B one by one as the non-piled, non-layered fold section, and FIG. 10 depicts the action relation between the rotating cam 330 and the fixed cam 331 in the collection mode output respective fold section 12A, 12B as the piling layered fold section in two piled state.

Non-collection mode

In the non-collection mode shown in FIG. 11, the clutch 45 assumes the OFF-state and the rotating cam 330 is interrupted.

When the cam follower 24 reaches the position corresponding to delivering operation KK (when the pin 15B reaches the delivering operation position K), the non-screening portion 330B is positioned at the position corresponding to delivering operation KK for the rotating cam 230 shown with the solid line in the drawing and the recessed portion 330B in the fixed cam 331 is not screened.

Therefrom, when the cam follower 24 reaches the position corresponding to delivering operation KK (when next pin 15B reaches the delivering operation position K) after the collection cylinder 315 makes a 72 degree turn, the interrupting rotating cam 330 holds the solid line position in the drawing, hence the recessed portion 331A in the fixed cam 331 remains non-screened.

Consequently, every time the pin 15B reaches the delivering operation position K, the pins 15B undergo the re-projecting action and the disappearing action and respective fold section 12A, 12B are delivered to the gripper cylinder 16 as the non-piled, non-layered fold section.

The position of the rotating cam 330 shown with the solid line in the drawing is one example of the stop position of the rotating cam 330 and is an optional position as long as the recessed portion 331A in the fixed cam 331 is under the circumstance of non-screening.

Collection mode

On the other hand, in the collection mode shown in FIG. 12, the clutch 45 assumes ON-state and the rotating cam 330 and the collection cylinder 315 revolve in the same direction (counter-clockwise). The rotation rate of the rotating cam 330 to the collection cylinder 315 is 5/4.

When the cam follower 24 reaches the position corresponding to delivering operation KK (when the pin 15B reaches the delivering operation position K), the non-screening portion 330B is positioned at the position corresponding to delivering operation KK for the rotating cam 330 shown with the solid line in the drawing, the recessed portion 331A in the fixed cam 331 is not screened.

Therefrom, when the collection cylinder 315 makes a 72 degree turn and next cam follower 24 reaches the position corresponding to delivering operation KK (when next pin 15 reaches the delivering operation position K), the rotating cam 330 assumes the position represented by the two-dot chain line in the drawing owing to a turn of 90 degrees; and in above state, the screening portion 330A is positioned at the position corresponding to delivering operation KK and the recessed portion 331A in the fixed cam 331 becomes screened.

Owing to a repeat of the foregoing description, when the pin 15B reaches the delivering operation position K, every two times the pins 15B undergo the re-projecting action and the disappearing action, and respective fold sections 12A, 12B are delivered to the gripper cylinder 16 as the pile layered fold section.

The change-over operation between the collection mode and the non-collection mode is automatically practiced by a process as shown in the flowcharts of FIG. 7 and 8 for the first embodiment.

The capacities in the third embodiment, like the first embodiment, are effective to protect from the load deviation originating in the drive system in the rotating cam 330, to improve the cutting accuracy and the folding accuracy in the fold section 12A, 12B, to extend machine life, to facilitate the change-over operation and shorten the changing time, and also because the rotating cam 330, has screening portion 330A at two symmetrical points on the peripheral portion. After all the clutch 45 can be structured to connect with the rotating cam 330 at predetermined one phase in accordance with the optional one state for the collection cylinder 315, and to connect with the rotating cam 330 at predetermined two phases for a 180 degree phase in accordance with the optional one state for the collection cylinder 315.

It is to be understood that the present invention is not intended to be limited to the above-described embodiments, and various changed may be made therein without departing from the spirit of the present invention, for example following modifications.

The brake 60 is not limited to the stationary means described in the respective embodiments, and might be structured to stably hold respective rotating cam 30, 230 and 330 by directly engaging in the non-collection mode, that is, brake 60 may stably hold respective rotating cam 30, 230, 330 in interrupted interlock with the collection cylinder 15 in the OFF condition of clutch 45 at the defined position.

In the second and third embodiments, configuration of respective rotating cams 230, 330 are assigned a geometric configuration symmetrical rotating axis, and in the second and third embodiment, configuration of respective rotating cams 230, 330 will be optional if the screening portion is formed with an adequate dimension for the point symmetry with respect to the rotating axis. For example, I-configuration or H-configuration.

In the first embodiment, the configuration of the rotating cam will be optional if the screening portion is formed with an adequate dimension.

The change-over operation among the non-collection mode and the collection mode is operated by the control device 70 in the respective embodiments, but an operator might operate respective operations for ON-OFF of the brake 60, ON-OFF of the clutch 45 and other things manually.

The rotation ratio of respective rotating cam 30, 230, 330 to the collection cylinder are respectively 3/2, 314, 5/4 in the first, second, third embodiments, and in this present invention, other rotation rates are applied by modification of the replacement of the screening portion in the rotating cam and on the number of pin's line on the collection cylinder.

The folding machine with collection mechanisms 10, 200, 300 are structured for a stationary type of tucker blade 15A in the collection cylinder in the respective embodiments and might be structured for a moving type of tucker blade and the same goes for the collection mechanism as in the case for the pin 15B.

The second and third embodiments are composed such that the ratio of the rotational frequency N2 of the clutch gear 46 to the rotational frequency N3 of the rotating cam gear 47 (the rotational frequency N3 of the rotating cam) is equal with the rotational frequency N2/the rotational frequency N3=2 and that the structure of clutch connected at predetermined two phase of a 180 degree phase in the rotating cam in accordance with an optional state of the collection cylinder and a structure of clutch is allowed to connect at predetermined two phase of a 180 phase on the rotating cam in accordance with an optional state of the collection cylinder by means of the rotational frequency N2/the rotational frequency N3=1 and a 2-point clutch in the clutch 45 (the clutch is connected the clutch boss 41 side and the clutch gear 46 side at predetermined two phase, that is, the clutch is connected at two positions during the clutch boss 41 and the clutch gear 46 are relatively made a full circle).

The folding machine with collection mechanism 10, 200, 300 in the respective embodiments include the gripper cylinder 16 and in this present invention a folding machine with collection mechanism including two gripper cylinders is allowed.

In this present invention as in the foregoing description, the cam profile is not provided in the rotating cam but in the fixed cam, so that it is possible that reduction of the load deviation generated in the drive system of the rotating cam, advancement in the cutting accuracy and the folding accuracy in the fold section and extension of machine life and the change-over between the non-collection mode and the collection mode are performed by only changing the state of the rotating cam, so that there can be ease of the change-over operation, shortening of changing time and a simple structure for the collection mechanism is provided.

What is claimed is:

1. A folding machine with a collection mechanism for selectively operating in a non-collection mode delivering two separate fold sections, which are sent alternately, one by one as a non-piled, non-layered fold section from a collection cylinder to a gripper cylinder and for selectively and alternatively operating in a collection mode delivering piled, layered fold sections, said folding machine comprising:

a fixed cam which has a cam profile including a recessed portion for alternately carrying out a predetermined delivering action of pins in said collection cylinder;

a rotating cam having a screening portion for screening said cam profile; and a rotating cam drive means for locating the screening portion of said rotating cam to not screen said portion of said cam profile when the pins reach a predetermined delivering action position in said non-collection mode and for locating the screening portion of said rotating cam to screen said portion of said cam profile every other time the pins reach sail predetermined delivering action position in said collection mode.

2. A folding machine with collection mechanism according to claim 1, wherein said rotating cam drive means is constructed and arranged to rotate said rotating cam at a predetermined rotation rate relative to said collection cylinder in said collection mode and to cause said rotating cam to interrupt at a position where the screening portion does not screen said cam profile in said non-collection mode.

3. A folding machine with collection mechanism according to claim 2, wherein said rotating cam drive means includes a drive transmission system provided between said collection cylinder and said rotating cam and a clutch provided to decouple said drive transmission system from a remainder of the rotating cam drive means and to intermittently interlock with said collection cylinder and said rotating cam.

4. A folding machine with collection mechanism according to claim 3, wherein said rotating cam has the rotation rate of 3/2 to said collection cylinder in the collection mode and has said screening portion at one position on the peripheral portion, and wherein said clutch causes said rotating cam to connect at predetermined one phase for an optional state of said collection cylinder.

5. A folding machine with collection mechanism according to claim 3, wherein said rotating cam has a rotation rate of one of 3/4 and 5/4 to said collection cylinder in said collection mode and has said screening portion at two almost symmetrical positions about the rotating axis, and wherein said clutch causes said rotating cam to connect at one of predetermined one phase and predetermined two phase in 180 degree phase, respectively, for an optional state of said collection cylinder.

6. A folding machine with collection mechanism according to claim 5, wherein said clutch is a one-point clutch to connect a part of a side of said collection cylinder containing said clutch and a part of a side of said rotating cam only at predetermined one phase, and wherein said clutch of part of said rotating cam is equal or two times the rotating rate of the rotating cam.

7. A folding machine with collection mechanism according to claim 3, wherein said rotating cam drive means includes an air cylinder to be operated remotely to control the ON-OFF state of said clutch, a phase sensing means for detecting the phase of said rotating cam, and a stationary means for holding fast in said interrupt state of said rotating cam in said non-collection mode.

8. A folding machine with collection mechanism according to claim 7, wherein said rotating cam drive means includes a control device to changeover automatically between said collection mode and said non-collection mode by controlling said air cylinder.

* * * * *